US007695157B2

(12) United States Patent
Yaphe et al.

(10) Patent No.: US 7,695,157 B2
(45) Date of Patent: Apr. 13, 2010

(54) LIGHT FIXTURE AND ASSEMBLY

(75) Inventors: Howard Yaphe, Ville St. Laurent (CA); Robert Katz, Montreal (CA); Sylvain Duchesne, Bromont (CA); Jean Gagne, St. Vaudreuil-Dorion (CA); Andrew Miles, Cornwall (CA)

(73) Assignee: Canlyte Inc., Lachine, Quebec, CA (US)

( * ) Notice: Subject to any disclaimer, the term of this patent is extended or adjusted under 35 U.S.C. 154(b) by 487 days.

(21) Appl. No.: 11/619,710

(22) Filed: Jan. 4, 2007

(65) Prior Publication Data

US 2007/0165399 A1 Jul. 19, 2007

Related U.S. Application Data

(60) Provisional application No. 60/756,370, filed on Jan. 5, 2006.

(51) Int. Cl.
*F21S 4/00* (2006.01)

(52) U.S. Cl. ..... 362/217.1; 362/147; 362/217.01

(58) Field of Classification Search ..... 362/147, 362/217.14, 217.16, 217.17, 225
See application file for complete search history.

(56) References Cited

U.S. PATENT DOCUMENTS

| | | | |
|---|---|---|---|
| 2,344,935 | A | 3/1944 | Whittaker |
| 2,567,726 | A | 9/1951 | Pistey |
| 2,722,666 | A | 11/1955 | Hodgkins |
| 2,769,897 | A | 11/1956 | Rzeszutko |
| 2,988,633 | A | 6/1961 | Rosenfield |
| 3,097,903 | A | 7/1963 | Moore |
| 3,299,264 | A | 1/1967 | Lipscomb |
| 3,426,312 | A | 2/1969 | Gerald |
| 3,428,799 | A | 2/1969 | Bassani |
| 3,464,727 | A | 9/1969 | Pascucci |
| 3,524,050 | A | 8/1970 | Gustine |
| 3,685,003 | A | 8/1972 | Watt |
| 3,832,540 | A | 8/1974 | Roth |
| 3,909,100 | A | 9/1975 | Hodge, Jr. |
| 3,911,265 | A | 10/1975 | Landrum et al. |
| 4,001,571 | A | 1/1977 | Martin |
| 4,070,570 | A | 1/1978 | Wetmore et al. |
| 4,198,108 | A | 4/1980 | Bassetto |
| 4,288,846 | A | 9/1981 | Fletcher et al. |
| 4,322,783 | A | 3/1982 | Chappell et al. |
| 4,323,953 | A | 4/1982 | Hutchison |
| 4,338,653 | A | 7/1982 | Marrero |
| 4,422,712 | A | 12/1983 | Koszytorz |
| 4,498,126 | A | 2/1985 | Hernandez |
| 4,533,851 | A | 8/1985 | Block et al. |
| 4,536,832 | A | 8/1985 | Lemons |
| 4,542,947 | A | 9/1985 | Flor et al. |
| 4,597,035 | A | 6/1986 | Lettenmeyer |

(Continued)

*Primary Examiner*—Ali Alavi
(74) *Attorney, Agent, or Firm*—Middleton Reutling; John F. Salazar

(57) ABSTRACT

A housing support assembly for supporting a linear light fixture, said light fixture having an elongate linear housing for accommodating one or more than one lamp, the support assembly comprising a first planar support member and a second support member, said first planar support member being arranged to be releasably coupled with the second support member, said first planar support member conforming to a predetermined cross-sectional dimension of the linear housing for releasable coupling therewith, said support assembly being adapted to mount one or more than one lamp socket thereon.

32 Claims, 23 Drawing Sheets

U.S. PATENT DOCUMENTS

| | | | |
|---|---|---|---|
| 4,636,841 | A | 1/1987 | Salestrom et al. |
| 4,722,039 | A | 1/1988 | Gaugel |
| 4,726,781 | A | 2/1988 | Bernhart et al. |
| 4,744,767 | A | 5/1988 | Henrici et al. |
| 4,803,600 | A | 2/1989 | Pepping |
| 4,842,535 | A | 6/1989 | Velke, Sr. et al. |
| 4,866,583 | A | 9/1989 | Targetti |
| 4,933,820 | A | 6/1990 | Engel |
| 5,006,970 | A | 4/1991 | Mackiewicz |
| 5,109,323 | A | 4/1992 | Waycaster |
| 5,113,328 | A | 5/1992 | Foster et al. |
| 5,124,896 | A | 6/1992 | Bentley |
| 5,226,724 | A | 7/1993 | Kanarek |
| 5,436,816 | A | 7/1995 | Nagano |
| 5,479,327 | A | 12/1995 | Chen |
| 5,493,482 | A | 2/1996 | Bowen |
| 5,521,805 | A | 5/1996 | Lim |
| 5,658,067 | A | 8/1997 | Engle et al. |
| 5,702,176 | A | 12/1997 | Engle |
| 5,716,123 | A | 2/1998 | Lamming |
| 5,746,502 | A | 5/1998 | Huang |
| 5,800,050 | A | 9/1998 | Leadford |
| 5,806,967 | A | 9/1998 | Soorus et al. |
| 6,186,642 | B1 | 2/2001 | Corcorran et al. |
| 6,305,816 | B1 | 10/2001 | Corcorran et al. |
| 6,523,975 | B1 * | 2/2003 | Plourde et al. ..... 362/225 |
| 6,530,674 | B2 | 3/2003 | Grierson et al. |
| 6,568,830 | B2 | 5/2003 | Yaphe et al. |
| 6,634,772 | B2 | 10/2003 | Yaphe et al. |
| 6,817,732 | B1 | 11/2004 | Knoble et al. |
| 7,055,982 | B2 | 6/2006 | Yaphe et al. |

* cited by examiner

LIGHT FIXTURE AND ASSEMBLY

REFERENCE TO CO-PENDING APPLICATIONS

The entire subject matter of U.S. application Ser. No. 10/689,191 entitled LINEAR FIXTURE SUSPENSION SYSTEM and filed Oct. 20, 2003 is incorporated by reference. The entire subject matter of U.S. application Ser. No. 10/898,813 entitled LINEAR FIXTURE ASSEMBLY and filed Jul. 26, 2004 is incorporated by reference. The entire subject matter of U.S. Provisional application Ser. No. 60/756,370 filed Jan. 5, 2006 and entitled LIGHT FIXTURE AND ASSEMBLY is incorporated by reference. The applicants claim priority benefit under Title 35, United States Code, Section 119 of U.S. Provisional application Ser. No. 60/756,370 filed Jan. 5, 2006 and entitled LIGHT FIXTURE AND ASSEMBLY

TECHNICAL FIELD

The invention relates to the suspension or support of light fixtures.

BACKGROUND ART

Connecting and mounting components of linear light fixtures are manufactured to particular specifications and are accordingly assembled together. Typical linear lighting fixtures are suspended from an overhead structure and include a limited number of linear fluorescent lighting systems having a restricted number of light sources. Such lighting fixtures may radiate light upwards against the ceiling or downwards towards the area to be illuminated.

Typical linear light fixtures have a linear housing supported by a number of support assemblies. Usually, adjacent linear housings are joined together by pair of corresponding support assemblies which are held together by a suspension arrangement.

The support assembly includes a support member which is relatively complex in structure and performs a number of functions. It has a number of formations which allow for the passage of electrical and operational signals and is shaped to fit snugly within the housing.

The overall shapes of linear housings vary considerably due to the very nature of their aesthetic appearance, for example, in accordance with the surrounding environment in which the housing of the linear light fixtures has a chosen place. The aesthetic appeal of the housing frequently changes with varying tastes and/or varying locations. Thus, the need to change the shape of the linear housing results in the redesign and remanufacture of the relatively complex support member.

It is an object of the present invention to obviate or mitigate disadvantages of the prior art or to provide an alternative thereto.

SUMMARY OF THE INVENTION

In one of its aspects, the present invention provides a housing support assembly for supporting a linear light fixture, said light fixture having an elongate linear housing for accommodating one or more than one lamp, the support assembly comprising a first planar support member and a second support member, said first planar support member being arranged to be releasably coupled with the second support member, said first planar support member conforming to a predetermined cross-sectional dimension of the linear housing for releasable coupling therewith, said support assembly being adapted to mount one or more than one lamp socket thereon.

In an alternative embodiment, the linear housing has a cross sectional profile, the first planar support member further comprising a first planar body portion having a profile which is complementary with the cross-sectional profile of the linear housing.

In an alternative embodiment, the first planar body portion further includes one or more than one mounting flange for releasably mounting said lamp socket thereon.

An alternative embodiment further comprises a pair of mounting flanges, each arranged adjacent the second support member.

In an alternative embodiment, the first planar body portion further includes a central receiving region for receiving the second support member therein and a pair of opposed positioning flanges, each positioning flange being located on a corresponding side of the central receiving region.

An alternative embodiment further comprises a pair of positioning flanges, each being adjacent a corresponding mounting flange. Each positioning flange extends between the first planar body portion and the corresponding mounting flange. In one example, the second support member is dimensioned to engage the positioning flanges.

In an alternative embodiment, each mounting flange extends parallel to the first planar body portion.

In an alternative embodiment, the mounting flanges, the positioning flanges and the first planar body portion are formed from a one piece metallic plate member.

In an alternative embodiment, the first planar support member further includes one or more than one anchoring flange projecting from the first planar body portion, said anchoring flange being arranged for releasable attachment to the second support member. In one example, the second support member further includes one or more than one anchoring tab extending therefrom.

An alternative embodiment further comprises a pair of first anchoring flanges on the first planar body portion and a pair of first anchoring tabs on the second support member, each first anchoring flange to align with a corresponding first anchoring tab to receive a fastener therewith.

In an alternative embodiment, the first anchoring tab is operable for releasable attachment to a corresponding first anchoring flange of the first planar support member.

An alternative embodiment further comprises one or more second anchoring flanges extending from opposite regions of the first planar body portion, each second anchoring flange to be oriented to align with a corresponding first anchor location in the linear housing to receive a fastener therewith.

An alternative embodiment further comprises one or more second anchor tabs on opposite sides of the second body portion, each to align with a corresponding second anchor location on the linear housing to receive a fastener therewith.

Another alternative embodiment further comprises a riser member, the second support member further including one or more than one releasable receiving flange to accommodate the riser member.

In an alternative embodiment, the riser member includes a central region to accommodate one or more than one lamp socket thereon. In one example, the riser member further includes a pair of anchoring flanges each on an opposite side of the central region.

In an alternative embodiment, the second support member further includes an upper surface and a ridge extending above the upper surface, the riser member further including a locating groove for engaging the riser member.

Another alternative embodiment further comprises a tongue outwardly extending from the second member to support one or more than one lamp thereon.

In still alternative another embodiment, the tongue is releasably attachable to the second support member.

In yet alternative another embodiment, the first planar support member is made from a metal and/or a plastic or a combination thereof.

In an alternative embodiment, the second support member, the riser member and/or the tongue are molded from plastic and/or metal or a combination thereof.

In another alternative aspect, the present invention provides a device for use in suspending adjacent light fixture sections of a linear light fixture assembly from an overhead structure, comprising a hanger member and suspension means for suspending the hanger member from the overhead structure, the hanger member having two elongate alignment members and a bridge member therebetween, each alignment member having a pair of opposed tongue portions for engaging a corresponding pair of first support formations in the adjacent linear light fixture sections; each of the tongue portions being arranged for engaging a corresponding locking flange adjacent the first support formation; said alignment member having a pair of spaced support flanges extending therefrom, a clamping member supported between the spaced support flanges for movement relative thereto, the clamping member having a pair of opposed wings for engaging a corresponding pair of second support formations in the adjacent linear light fixture sections, said wings being adjacent the corresponding second support formations when the tongue portions are engaged with the corresponding first support formations, each clamping member being movable to bring the wings into clamping engagement with the second support formations and to move the adjacent linear fixture sections into locking engagement with the hanger member.

In an alternative embodiment, each of the light fixture sections includes a housing, an end cap and/or a housing support assembly.

In another alternative embodiment, the tongue portions are movable relative to the bridge member and each alignment member includes a span member for engaging the bridge member. The bridge member includes a pair of upstanding peripheral regions to form an inner surface region therebetween, the span member of each alignment member engaging the inner surface region. The span member is releasably attached to the bridge member for lateral adjustment relative thereto. The tongue portions on each alignment member have a common recess. Each alignment member includes a pair of upstanding peripheral portions on opposite sides of the common recess.

In an alternative embodiment, each second support formation includes a rib portion, each wing having an upstanding lip extending therefrom for operably engaging the rib portion.

In an alternative embodiment, each alignment member further includes a span member to slidably engage a corresponding end region of the bridge member.

In an alternative embodiment, the support means includes a cable assembly having an end portion, the span member further including a first passage which is dimensioned to receive the end portion.

In an alternative embodiment, the span member is adjustable relative to the bridge member to accommodate variations in the first support formations.

An alternative embodiment further comprises releasable locking means for locking the span member in position relative to the bridge.

In an alternative embodiment, the span member includes a second passage, the locking means including a fastener to extend through the second passage. The second passage is aligned with a corresponding passage in the bridge member to receive the fastener therethrough.

In an alternative embodiment, each clamping member includes a central interconnecting portion joining the wings together in a V-shaped orientation, each of the wings generally extending parallel to a corresponding tongue portion.

An alternative embodiment further comprises displacement means for displacing the clamping member relative to the opposing tongue portions from a first operative position to a second operative position.

In an alternative embodiment, the displacement means includes an adjustment screw passing between the alignment member and the central interconnecting portion of the V-shaped wing; the adjustment screw being adjusted to displace the central interconnecting member to clamp the wings against the second support formation in the second operative position.

In yet another alternative aspect, the present invention provides a device for use in suspending adjacent sections of a light fixture assembly from an overhead structure, comprising a hanger member and suspension means for suspending the hanger member from the overhead structure, the hanger member having two elongate alignment members, each alignment member having a pair of opposed tongue portions for engaging a corresponding pair of first support formations in the adjacent sections said alignment member having a pair of spaced support flanges extending therefrom, a clamping member supported between the spaced support flanges for movement relative thereto, the clamping member having a pair of opposed wings for engaging a corresponding pair of second support formations in the adjacent sections, said wings being adjacent the corresponding second support formations when the tongue portions are engaged with the corresponding first support formations, each clamping member being movable to bring the wings into clamping engagement with the second support formations and to move the adjacent sections into locking engagement with the hanger member.

In an alternative embodiment, each of the sections includes a housing, an end cap and/or a housing support assembly.

An alternative embodiment further comprises a bridge member extending between the elongate alignment members.

In still another alternative aspect, the present invention provides a housing support assembly for supporting a light fixture, said light fixture having an elongate linear housing for accommodating one or more than one lamp, the support assembly comprising a first planar support member and a second support member, said first support member having a central receiving region to receive the second support member and to be coupled therewith, said first planar support member conforming to a predetermined cross-sectional dimension of the linear housing for releasable coupling therewith, said support assembly being adapted to mount one or more than one lamp socket on the first and/or second support member.

In another alternative aspect, the present invention provides a kit for suspending adjacent light fixture sections of a linear light fixture assembly from an overhead structure, comprising a hanger member and suspension means for suspending the hanger member from the overhead structure, the hanger member having two or more elongate alignment members and a bridge member therebetween, each alignment member having one or more tongue portions for engaging a corresponding pair of first support formations in the adjacent linear light fixture sections; each of the tongue portions being arranged for engaging a corresponding locking flange adjacent the first support formation; said alignment member having a pair of spaced support flanges extending therefrom, a clamping member supported between the spaced support flanges for movement relative thereto, the clamping member having a pair of opposed wings for engaging a corresponding pair of second support formations in the adjacent linear light fixture sections, said wings being adjacent the corresponding second support formations when the tongue portions are engaged with the corresponding first support formations, each clamping member being movable to bring the wings into clamping engagement with the second support formations and to move the adjacent linear fixture sections into locking engagement with the hanger member.

In yet another alternative aspect, the present invention provides a device for use in suspending adjacent linear light fixtures from an overhead structure, comprising a hanger member and suspension means for suspending the hanger member from the overhead structure, the hanger member having a bridge member spanning two elongate alignment members, each alignment member having a pair of opposed tongue portions for engaging a corresponding pair of first support formations in the adjacent linear light fixtures, the opposed tongue portions having a common recess; each alignment member further including a lateral span member; a pair of opposed tabs, each of which is located adjacent one end of the common recess for engaging a corresponding raised ridge adjacent the first support formation in the linear light fixture, said alignment member having a pair of parallel support flanges extending downward from an underside of the alignment member, a clamping member supported between the parallel support flanges for vertical movement relative thereto, the clamping member having a pair of opposed wings for engaging a corresponding pair of second support formations in the adjacent linear light fixtures, said wings being adjacent the corresponding second support formations when the tab members are engaged with the corresponding first support formations, each clamping member being movable to bring the wings into clamping engagement with the second support formations and move the end portions of the adjacent linear fixtures towards each other into locking engagement with the hanger member.

In yet another alternative aspect, the present invention provides a housing support assembly for supporting a linear light fixture, said light fixture having an elongate linear housing for accommodating at least one lamp, the support assembly comprising a support plate member and a support block member, the support block member including support means for supporting the at least one lamp, the support plate member being arranged to support the support block member, the support plate member including one or more mounting portions extending outwardly therefrom and anchoring means for releasably coupling the one or more mounting portions with the elongate linear housing, the support plate member having an outer peripheral region which conforms to a corresponding peripheral region of the elongate linear housing, the block member providing a mounting location for one or more electrical couplings for powering the lamp.

In yet another alternative aspect, the present invention provides a method of preparing a plurality of different light fixture assemblies, comprising the steps of:

providing a pair of first support assemblies and a first housing, which when assembled form part of a first light fixture;

providing a pair of second support assemblies and a second housing, which when assembled form part of a second light fixture;

providing the first housing with a first cross sectional profile and the second housing with a second cross sectional profile which is different from the first cross sectional profile;

providing each first support assembly with a first plate member and a first block member supported thereby;

shaping the outer periphery of the first plate member to be complementary with at least a portion of the cross sectional profile of the first elongate linear housing;

providing each second support assembly with a second plate member and a second block member supported thereby, wherein the second block member and the first block member are substantially the same;

shaping the outer periphery of the second plate member to be complementary with at least a portion of the cross sectional profile of the second elongate linear housing;

locating an electrical and/or network coupling in one or both of the first block members of the first support assemblies for delivering power to an interior region of the first and elongate linear housing;

locating an electrical and/or network coupling in one or both of the second block members of the second support assemblies for delivering power to an interior region of the second elongate linear housings;

locating one or more lamps in the first and second elongate linear housings; and coupling each of the lamps with a corresponding electrical coupling.

In yet another alternative aspect, the present invention provides a method of reducing the cost of manufacturing linear light fixtures, comprising:

a step for providing a group of first elongate linear housings and a group of second elongate linear housings;

a step for providing a group of first support assemblies, of which two or more are to be assembled with one or more corresponding first elongate linear housings to form a first linear light fixture, and a group of second support assemblies, of which two or more are to be assembled with one or more corresponding second elongate linear housings to form a second linear light fixture;

a step for providing each of the first and second groups of support assemblies with a substantially standard lamp support member and a custom formed anchor plate member, wherein the custom formed anchor plate member has a custom formed outer periphery which is shaped to complement the cross sectional profile of the corresponding first or second elongate linear housing.

An alternative embodiment further comprises:

a step for forming a first linear light fixture by assembling two or more first support assemblies with one or more corresponding first elongate linear housings; and a step for locating an electrical coupling in at least one of the standard lamp support members in each of the first support assemblies, for delivering power to one or more lamps to be located in the first elongate linear housing; and a step for installing one or more lamps in the first elongate housing.

Another alternative embodiment further comprises:

a step for forming a second linear light fixture by assembling two or more second support assemblies with one or more corresponding second elongate linear housings; and a step for locating an electrical coupling in at least one of the standard lamp support members in each of the second support assemblies, for delivering power to one or more lamps to be located in the second elongate linear housing; and a step for installing one or more lamps in the second elongate housing.

In yet another alternative aspect, the present invention provides a kit for supporting a linear light fixture, said light fixture having an elongate linear housing for accommodating at least one lamp, the support assembly kit comprising a support plate member; and a support block member, the support block member including support means for supporting the at least one lamp, the support plate member being arranged to support the support block member, the support plate member including one or more mounting portions extending therefrom and anchoring means for releasably coupling the one or more mounting portions with the elongate linear housing, the support plate member having an outer peripheral region which conforms to a corresponding peripheral region of the elongate linear housing, the block member providing a mounting location for one or more electrical couplings for powering the lamp.

In still another alternative aspect, the present invention provides a kit for suspending adjacent light fixture sections of a linear light fixture assembly from an overhead structure, comprising a hanger member and suspension means for suspending the hanger member from the overhead structure, the hanger member having two elongate alignment members and a bridge member therebetween, each alignment member having a pair of opposed tongue portions for engaging a corresponding pair of first support formations in the adjacent linear light fixture sections; each of the tongue portions being arranged for engaging a corresponding locking flange adjacent the first support formation; said alignment member having a pair of spaced support flanges extending therefrom, a clamping member supported between the spaced support flanges for movement relative thereto, the clamping member having a pair of opposed wings for engaging a corresponding pair of second support formations in the adjacent linear light fixture sections, said wings being adjacent the corresponding second support formations when the tongue portions are engaged with the corresponding first support formations, each clamping member being movable to bring the wings into clamping engagement with the second support formations and to move the adjacent linear fixture sections into locking engagement with the hanger member.

In a further alternative aspect, there is provided a housing support assembly for supporting a light fixture, said light fixture having an elongate linear housing for accommodating one or more than one lamp, the support assembly comprising a first support blank and a second support member, said first support blank being formed with a central receiving region to receive the second support member, said first support blank having a peripheral region which is formed to conform to a predetermined cross-sectional dimension of the linear housing for releasable coupling therewith, said support assembly being adapted to mount one or more than one lamp socket thereon.

In an alternative embodiment, the first support blank is elongate.

In an alternative embodiment, the first support blank is planar.

In an alternative embodiment, the first support blank includes a stamped plate member.

In an alternative embodiment, first support blank is a plate member.

In an alternative embodiment, the plate member is planar.

In an alternative embodiment, the first support blank and the second support member are releasably coupled together.

BRIEF DESCRIPTION OF THE DRAWINGS

Several preferred embodiments of the present invention will now be described, by way of example only, with reference to the appended drawings in which.

DETAILED DESCRIPTION OF THE PREFERRED EMBODIMENTS

Figure 1:
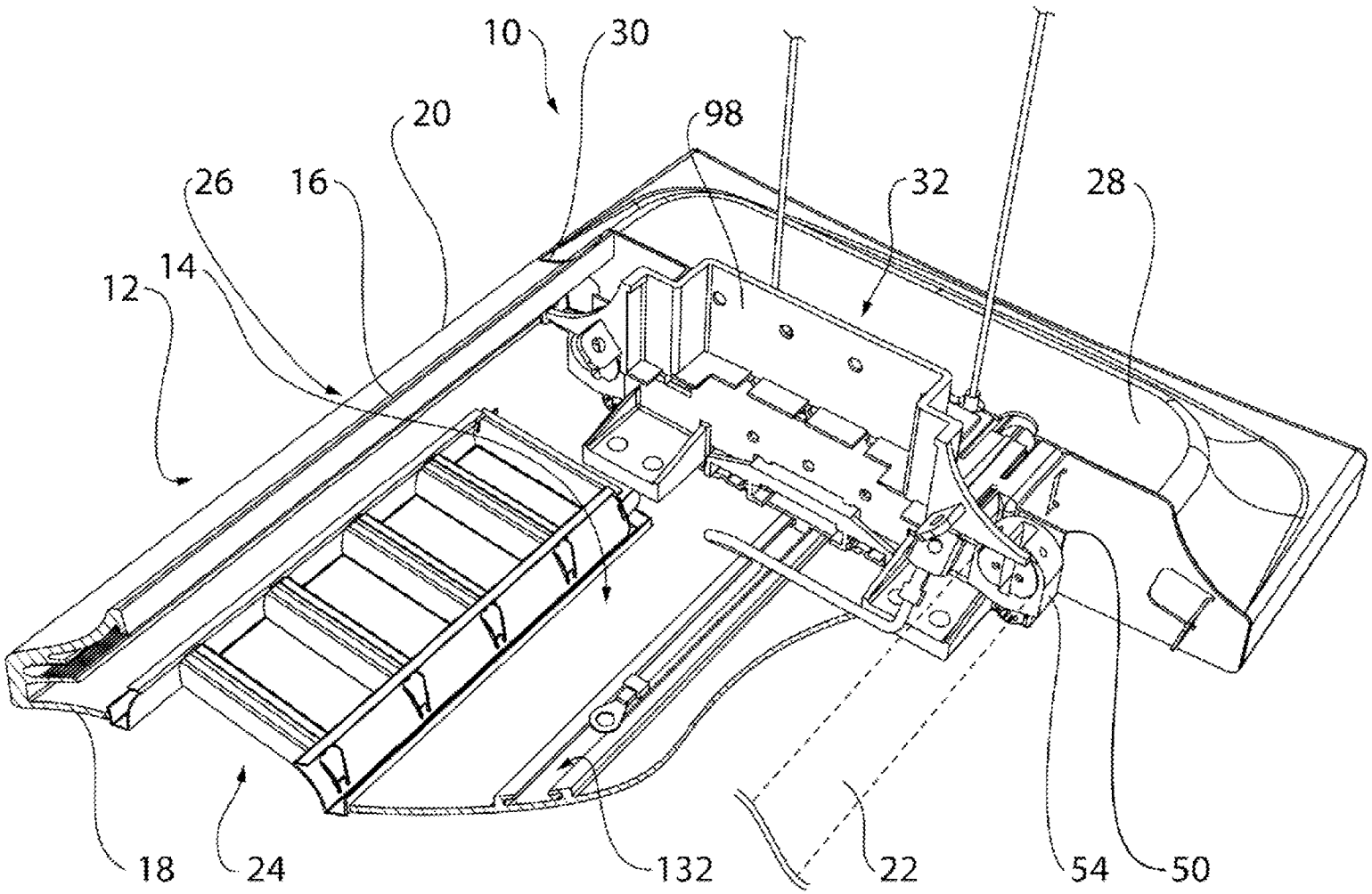
FIG. 1 is a fragmentary perspective view of a portion of a linear light fixture.

Referring to FIG. 1, there is shown a linear light fixture 10 for suspension from an overhead structure (not shown). The light fixture 10 has an elongate linear housing 12 that accommodates a light source, as will be described, to illuminate an area in the path of the emitted light. The area to be illuminated may, for example, be that of a home or a commercial office space.

The elongate linear housing 12 as shown in FIG. 1, defines a recess 14 with a top portion 16, a bottom portion 18 and side walls 20 that rise upwardly towards the top portion 16. The recess 14 accommodates the light source, in this case a fluorescent lamp, as shown with the dotted lines 22 in FIG. 1. Reflective means is provided at 24 to further illuminate the light being emitted from the light source. The linear housing 12 includes a main portion 26 for housing the light source. Situated at one end of the linear housing 12 there is an end portion 28 having a predetermined cross-section which is complementary to that of the main portion 26 wherein a common boundary 30 exists therebetween. A support assembly 32 is also provided for suspending the linear light fixture 10 from the overhead structure. As will be described, in one example, the support assembly is releasably coupled to the linear housing 12 at the common boundary 30. The linear housing 12 is made of a durable and light weight material, for example, a lightweight metal such as extruded aluminum or a plastic or a combination of the two materials.

Although the support assembly 32 is shown coupled to the common boundaries 30 of the linear housing 12 and the end portions 28, it should be appreciated that one or more than one support assembly 32 may be inserted along the length of the linear housing 12 and be connected to a further end portion 28 or to a further support assembly 32 or to a combination of both the end portion 28 and the support assembly 32.

Figure 2:
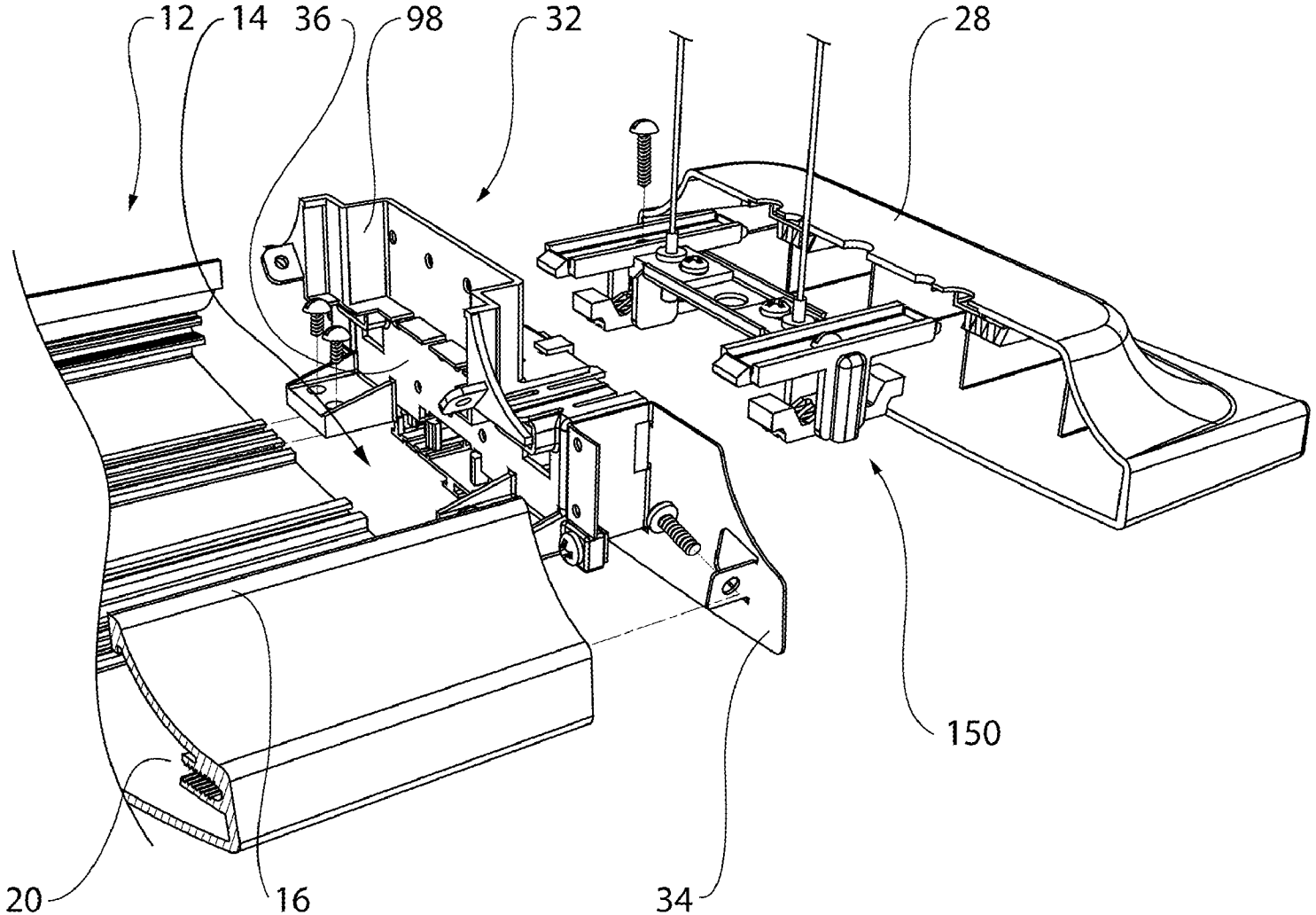
FIG. 2 is another perspective view of the portion of the fixture of FIG. 1.
Figure 3:
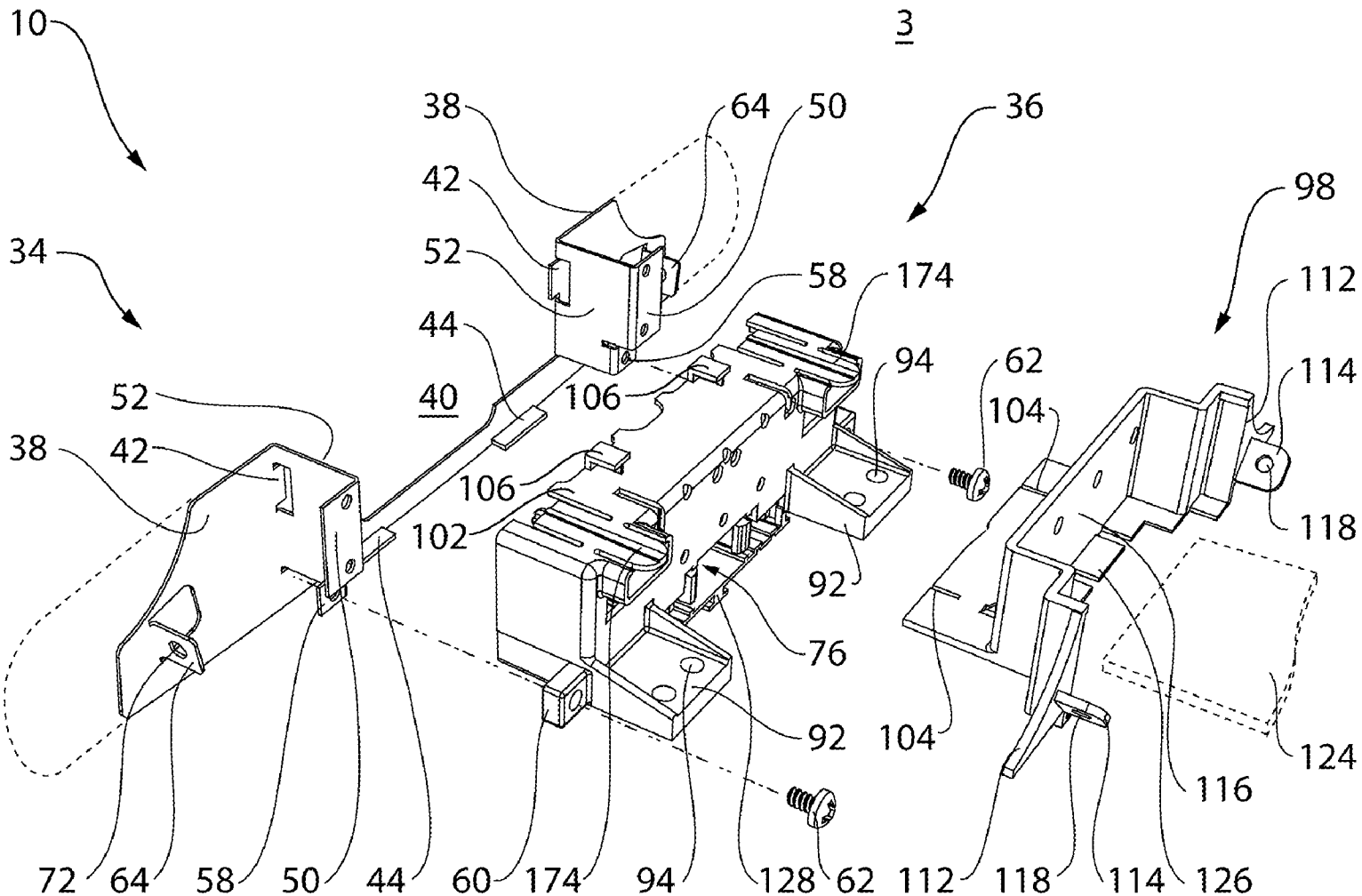
FIG. 3 is a perspective assembly view of a segment of the fixture of FIG. 1.

Referring to FIGS. 1, 2 and 3, the support assembly 32 includes a first support member 34. In one example, the support member 34 is planar but may be formed in such a manner that it is not planar. For example, the support member 34 may be provided with undulations or corrugations of a circular, triangular or rectangular cross section. In the example shown in FIGS. 1, 2 and 3, the support member 34 is planar and dimensioned to receive and accommodate a second support member 36. The first planar support member 34 has a planar body portion 38 with an outer profile that is complementary with a cross-sectional profile of the linear housing 12. It can be seen that the planar body portion 38 is sandwiched between the linear housing 12 and the end portion 28 at the common boundary 30. Alternatively, the cross sectional profile of the planar body portion 38 may be complementary to the inner cross-sectional profile of the linear housing 12, if desired. In this case, the planar support member 38 may be located within the linear housing 12. Thus, it will be understood that the outer periphery of the first planar support member 34 may be adjusted according to the profile of the linear housing 12. In this case, the dashed lines in FIG. 3 represent the outer periphery for an alternative linear housing (not shown).

The planar body portion 38 of the first planar support member 34 has a central receiving region 40 for receiving the second support member 36. The first planar support member 34 is releasably coupled to the second support member 36.

Figure 3A:
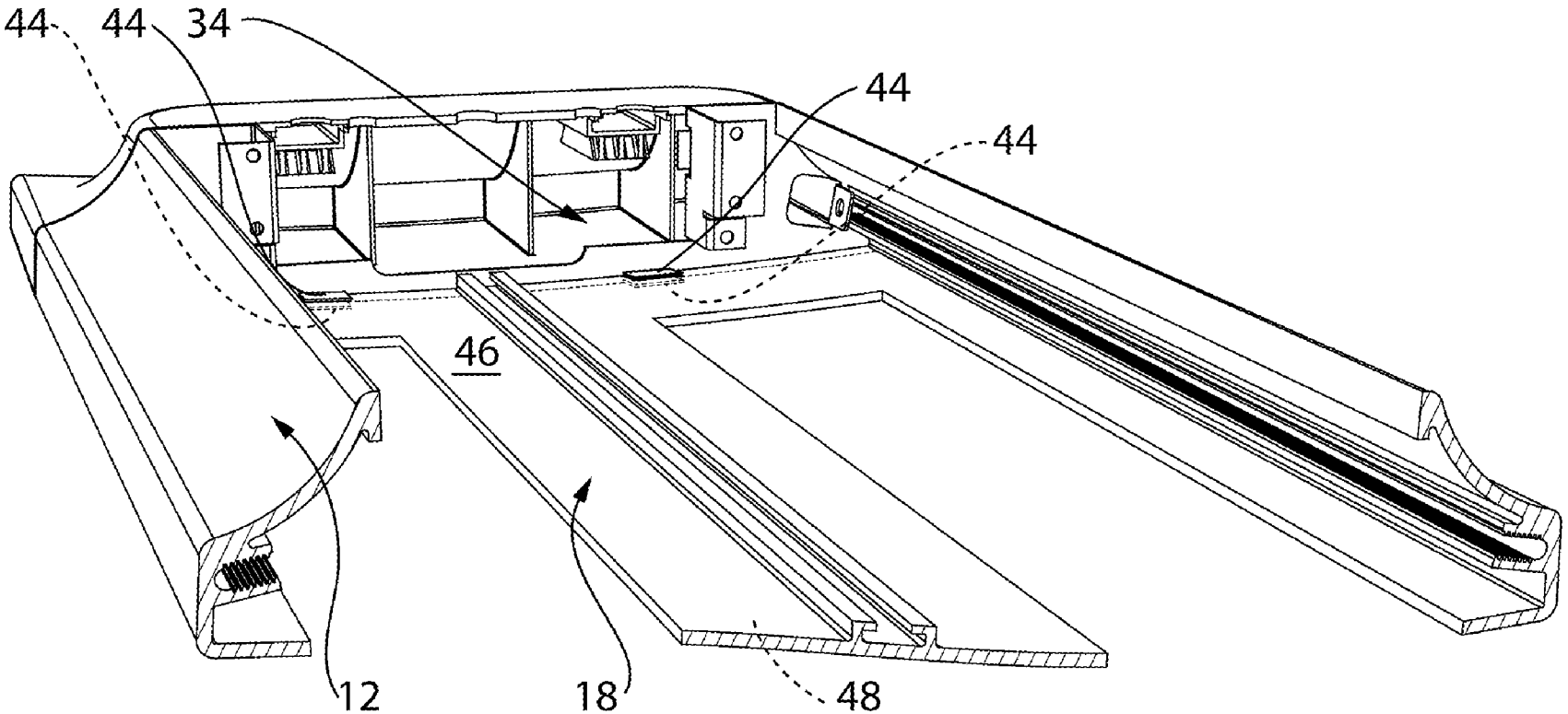
FIG. 3*a* is a fragmentary perspective view of the portion of the fixture of FIG. 1.

Integrally formed on the planar body portion 38 is a pair of first positioning flanges 42. Each first positioning flange 42 is located on a corresponding region of the planar body portion 38 adjacent the central receiving region 40. When the second support member 36 is attached to the first planar support member 34, each first positioning flange 42 abuts the second support member 36 restricting movement of the second support member 36 beyond the plane of the first planar support member 34. The planar body portion 38 further includes a pair of second positioning flanges 44, located in a region adjacent to the lower portion of the central receiving region 40. Referring to FIG. 3*a*, the second pair of positioning flanges 44 serve to align the first planar support member 34 with the bottom portion 18 of the elongate linear housing 12. As shown in FIG. 3*a*, in this case, the second positioning flanges 44 may be aligned with an upper surface 46 or a lower surface 48 of the bottom portion 18, or both as the case may be.

Referring again to FIG. 3, the first planar support member 34 includes a pair of mounting flanges 50, each mounting flange having an inner face 52. During the formation of the support assembly 32, the inner faces 52 of the mounting flange 50 slidably abut a corresponding side of the second support member 36. Accordingly the mounting flanges 50 serve to prevent or otherwise limit a sideways or lateral movement of the second support member 36. In addition, as can best be seen in FIG. 1, each of one of the mounting flanges 50 accommodates a lamp socket 54 position the light source 22.

Referring to FIG. 3, the planar body portion 38 includes a pair of first anchoring flanges 58 that aligns with a pair of integral first anchoring tabs 60 as provided on either side of the second support member 36. Each one of the first anchoring flanges 58 aligns with the corresponding first anchoring tabs 60 to receive a fastener 62 therethrough, for example a threaded screw, to couple the two components together. That being said, the first support member 34 need not be releasably coupled to second support member 36. Rather, the first and second support members may be located relative to one another and coupled to other structure, such as the housing 12.

Figure 4:
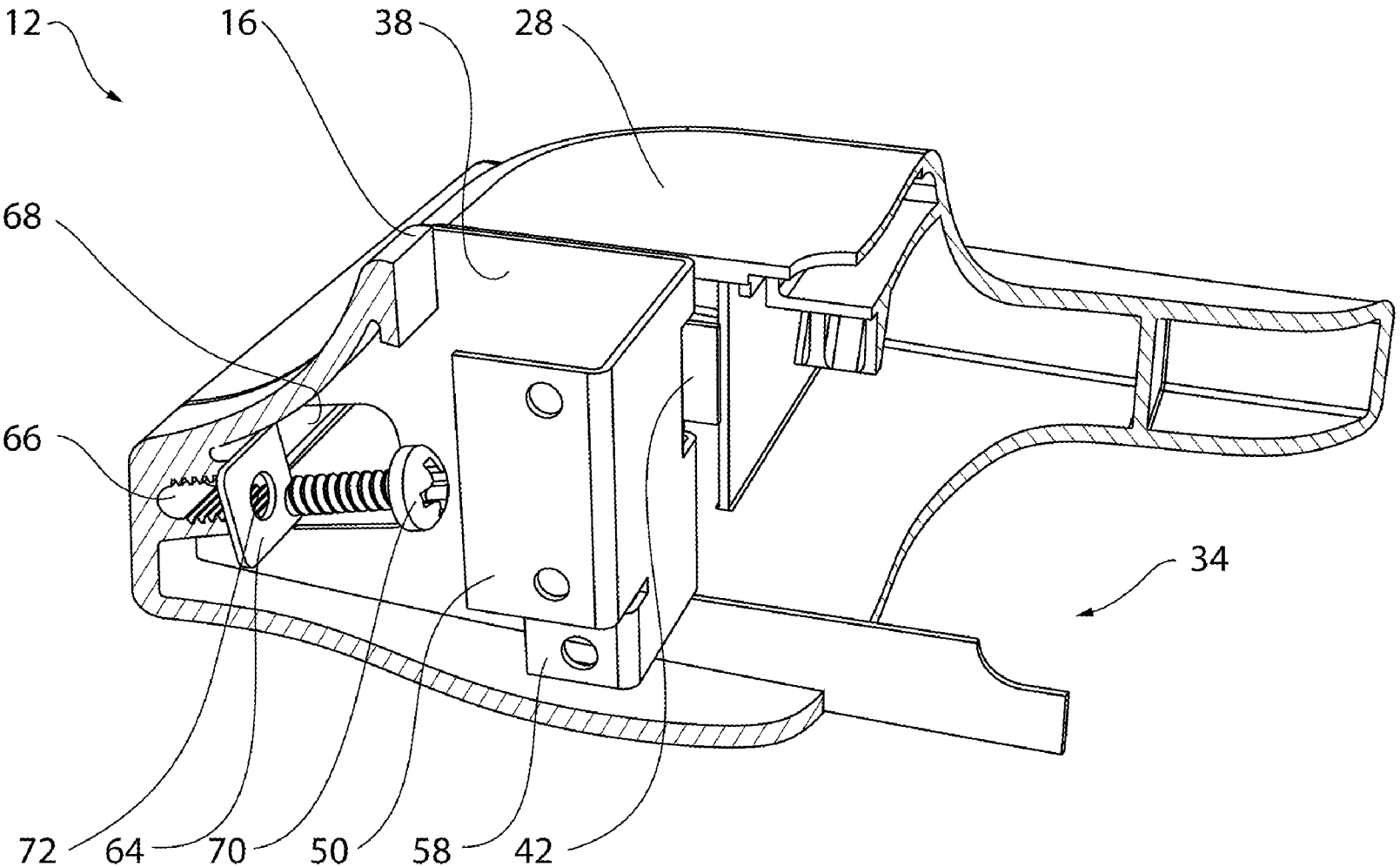
FIG. 4 is an enlarged view of another portion of the fixture of FIG. 1.

Referring to FIG. 4, extending from opposing end regions of the planar body portion 38 is a pair of second anchoring flanges 64 for attaching the first planar support member 34 to the linear housing 12. Each second anchoring flange 64 is oriented to align with a corresponding first anchor location 66 in a respective inner side wall 68 of the linear housing 12. The second anchoring flange 64 is held in position by a fastener 70, such as for example a threaded screw, that is directed through a passage 72 and into a corresponding inner side wall 68 of the linear housing 12, thereby mounting and securing the first planar support member 34 to the linear housing 12.

As can be best seen in FIG. 3, the mounting flanges 50, the first and second positioning flanges 42, 44 the second anchoring flanges 64 and the planar body portion 38 of the first planar support member 34 are all formed from a one piece metallic plate member. The planar body portion 38 is manufactured from stamped sheet metal and crafted for complementary engagement, both with the second support member 36 and the linear housing 12, though the planar body portion 38 may also be formed in more than one piece and by other methods such as molding, if desired. More particularly, the planar body portion 38 has an outer profile complementary with the cross-sectional profile of the linear housing 12. FIGS. 9 to 14 demonstrate several variations of the planar body portion 38, each having a different outer profile to accommodate a different linear housing profile and each receiving the same second support member 36. During the manufacturing process, connecting portions, such as flanges 42 and 58, are accordingly configured to align with and/or be releasably coupled with the connecting portions of the second support member 36, such as for example, the first anchoring tabs shown at 60. It will be seen that the flanges 44 and 50 used in connection with the first planar support member 34 are not utilized in this example, but may be if desired.

Figure 5:
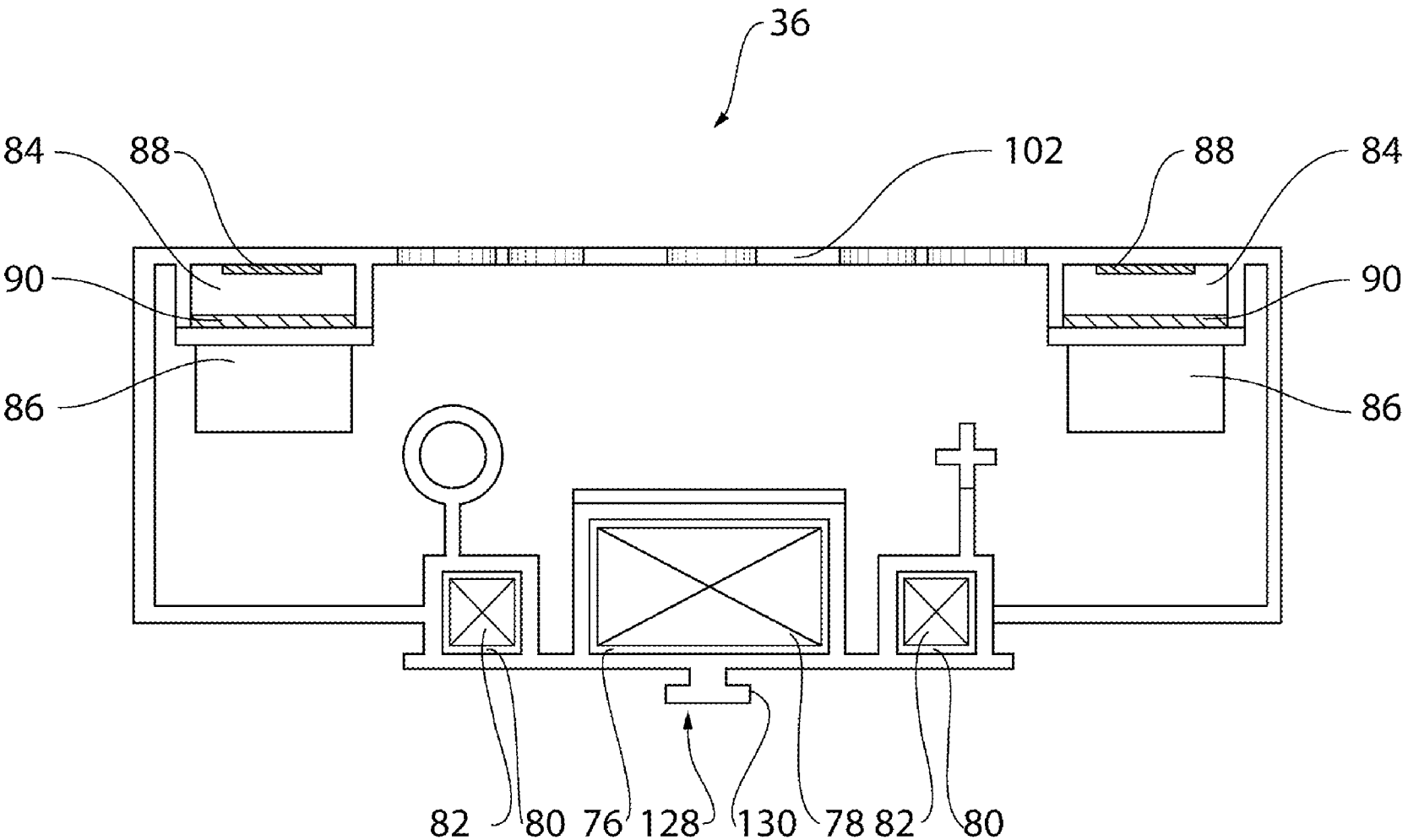
FIG. 5 is a plan view of a second support member.

Referring to FIG. 5, the second support member 36 is generally in the shape of a block and has a first central connector recess 76 that follows the shape of an electrical plug connector shown schematically at 78. The electrical plug connector 78 is mated to an adjacent linear light fixture plug connector and/or a power cable (both not shown). This configuration allows for a plurality of functioning linear light fixtures to be attached together in, for example, a linear series. On either side on the central connector recess 76, there is a second plug connector recess 80 to receive a second connector shown schematically at 82 which is operable to convey operational signals between adjacent light fixtures. Further details may be found in a pending application U.S. Ser. No. 10/689,191 filed Oct. 20, 2003, which is incorporated herein by reference in its entirety.

The second support member 36 has two pairs of support formations, each pair having a first support formation 84 and a second support formation 86, the first support formation 84 defining an elongate open ended recess. Located in the elongate recess of the first support formation 84 is an upper raised ridge 88 and a lower raised ridge 90, the significance of which is later described in detail. Further details of the second support formation 86 will be described below.

Figure 6:
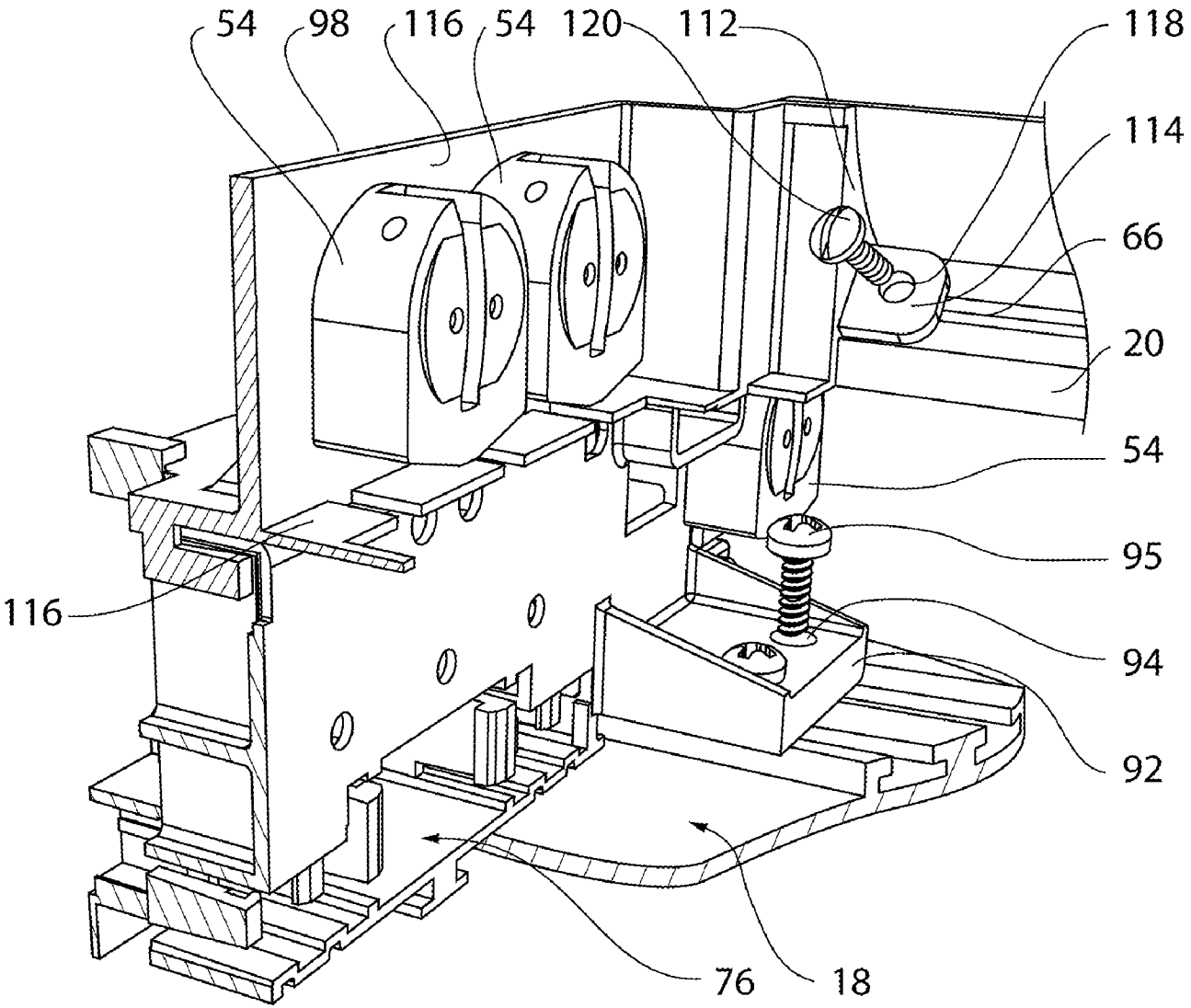
FIG. 6 is a fragmentary perspective assembly view of a portion of the fixture of FIG. 1.
Figure 7:
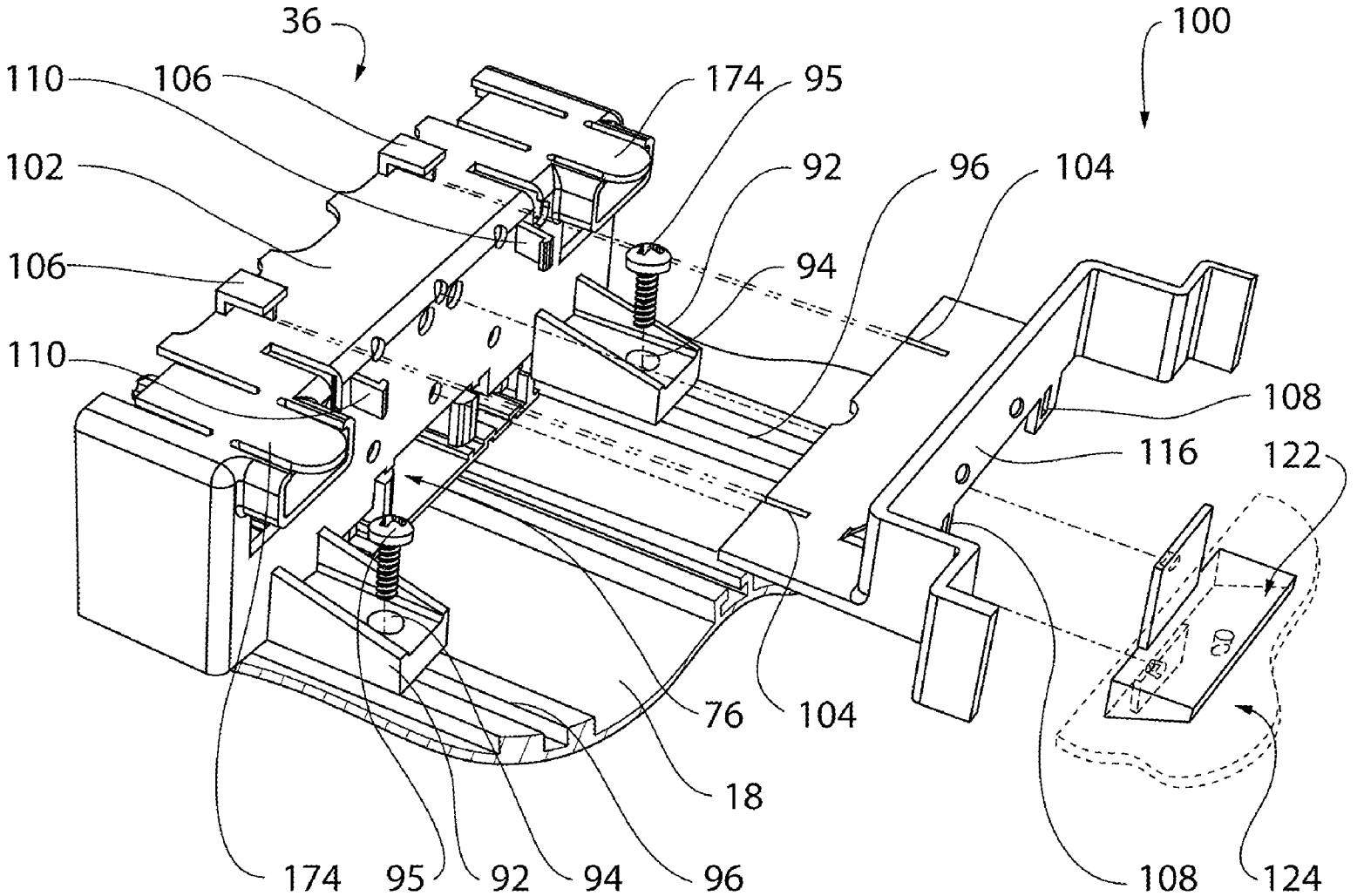
FIG. 7 is a fragmentary perspective part-assembly view of a portion of fixture of FIG. 1 in an alternative form.

Referring to FIGS. 3, 6 and 7, the second support member 36 further includes a pair of second anchoring tabs 92 that attach the second support member 36 horizontally to the inside bottom portion 18 of the linear housing 12. In FIG. 3, each of the second anchoring tabs 92 has a pair of receiving passages 94 while, in FIG. 7, the anchoring tabs 92 are shown having one receiving passage 94. In either case, the passages 94 receives fastener 95 and are aligned with a receiving groove 96 located in the bottom portion 18 of the linear housing 12. The second support member 36 is constructed of a plastic, such as molded plastic, or a metal or a combination of the two materials.

Referring to FIGS. 3, 6, 7 and 8, the linear light fixture 10 is arranged to accommodate further lamp sockets 54 by the use of two variations of riser members, one being shown in FIG. 3 at 98, and the second being shown in FIG. 7 at 100. Both the riser members 98 or 100 are mounted on a top surface 102 of and secured to the second support member 36. The two riser members 98 or 100 are attached to the second support member 36 in two different ways. In FIG. 7, the riser member 100 has two integral slots 104 that are correspondingly aligned with integral receiving guides 106 of the second support member 36. The riser member 100 has additional means to secure it to the second support member 36. In this case, securing means is provided in the form of two central receiving flanges 108 that are correspondingly aligned to receive two resilient clasps 110 located on the second support member 36.

As shown in FIG. 3, the riser member 98 also has integral slots 104 and their complementary integral receiving guides 106. In this case, riser member 98 has as a secondary attachment means in the form of a pair of riser member wings 112 having opposed anchoring flanges 114, as shown in FIGS. 3 and 6. Each riser member wing 112 is located on opposite sides of the central planar region 116. The anchoring flanges 114 each comprise a passage 118 for receiving a fastener 120 that passes therethrough and into a corresponding inner side wall 20 of the linear housing 12.

Figure 8:
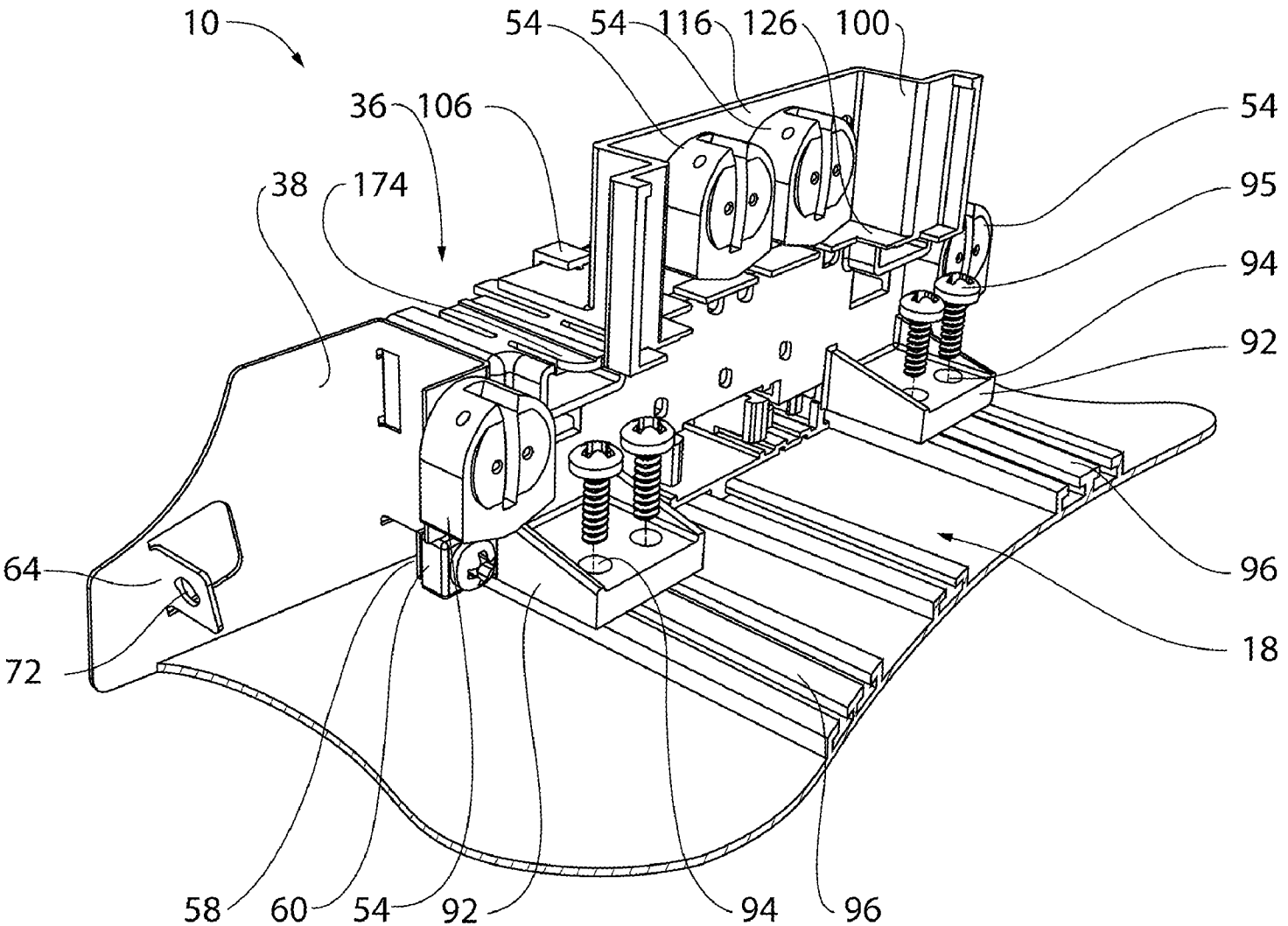
FIG. 8 is a fragmentary perspective view of another variation of the portion fixture of FIG. 1.

Referring to FIGS. 6 and 8, a pair of lamp sockets 54 is mounted on a central planar region 116 of the riser members 98 and 100.

Further features of the riser member 100 are shown in FIG. 7. Lying below the riser member 100 and below the central planar region 116, there is a detachable support tongue 122 that extends outwardly from the riser member 100 and assists in supporting a reflector panel shown in dotted lines at 124 adjacent the light source. Alternatively, the riser member 98 shown in FIGS. 3 and 8, as well as the version of riser member 100 in FIG. 8, have at least one integral horizontal extension 126, again for supporting the reflector panel 124 adjacent the light source.

Figure 3B:
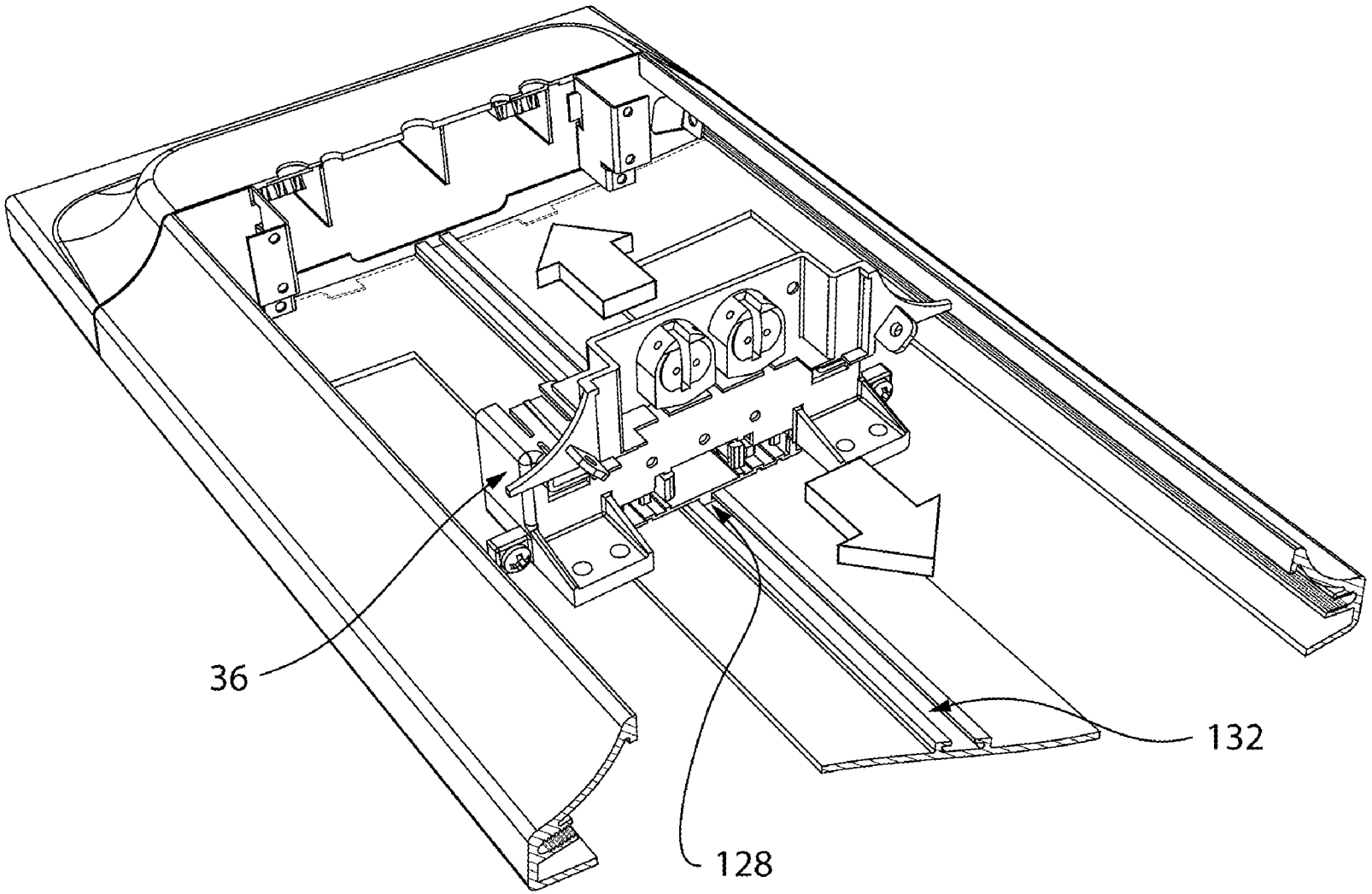
FIG. 3*b* is a fragmentary perspective view of the portion of the fixture of FIG. 1 in another configuration.

As can be seen in FIGS. 1 and 5, the second support member 36 is further provided with an anchor flange 128 which extends downwardly from a central regional thereof and has a pair of oppositely extending tabs 130 forming an inverted "T" cross section. The oppositely extending tabs 130 engage a central track formation 132 formed along a central region of the bottom portion 18. This allows the second support member 36 and the bottom portion 18 both to be properly aligned and engaged. Moreover, the engagement allows the second support member 36 to be positioned at different positions along the length of the bottom portion 18, if desired, as shown in FIG. 3*b*.

Figure 8A:
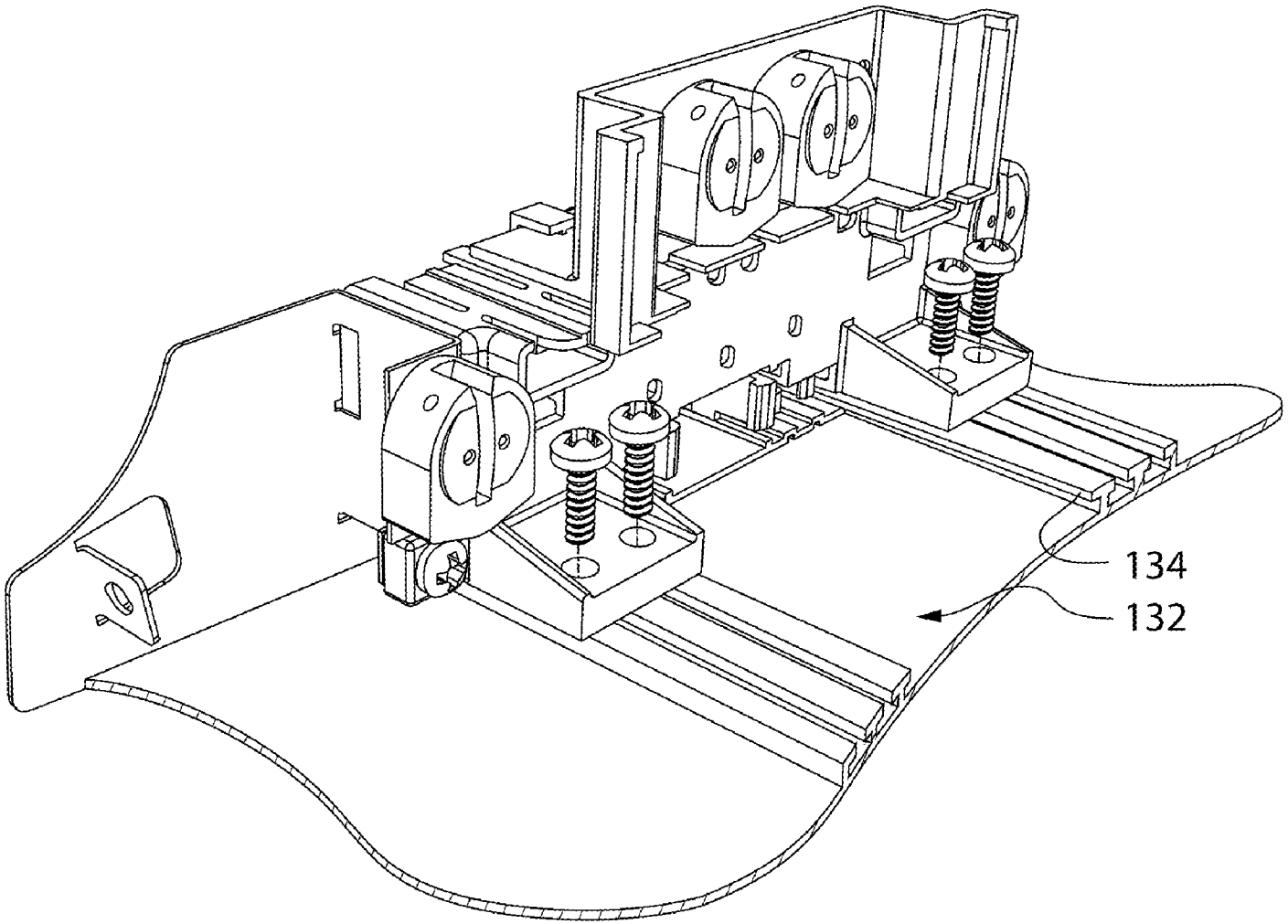
FIG. 8*a* is a fragmentary perspective view of another variation of portion of FIG. 7.
Figure 8B:
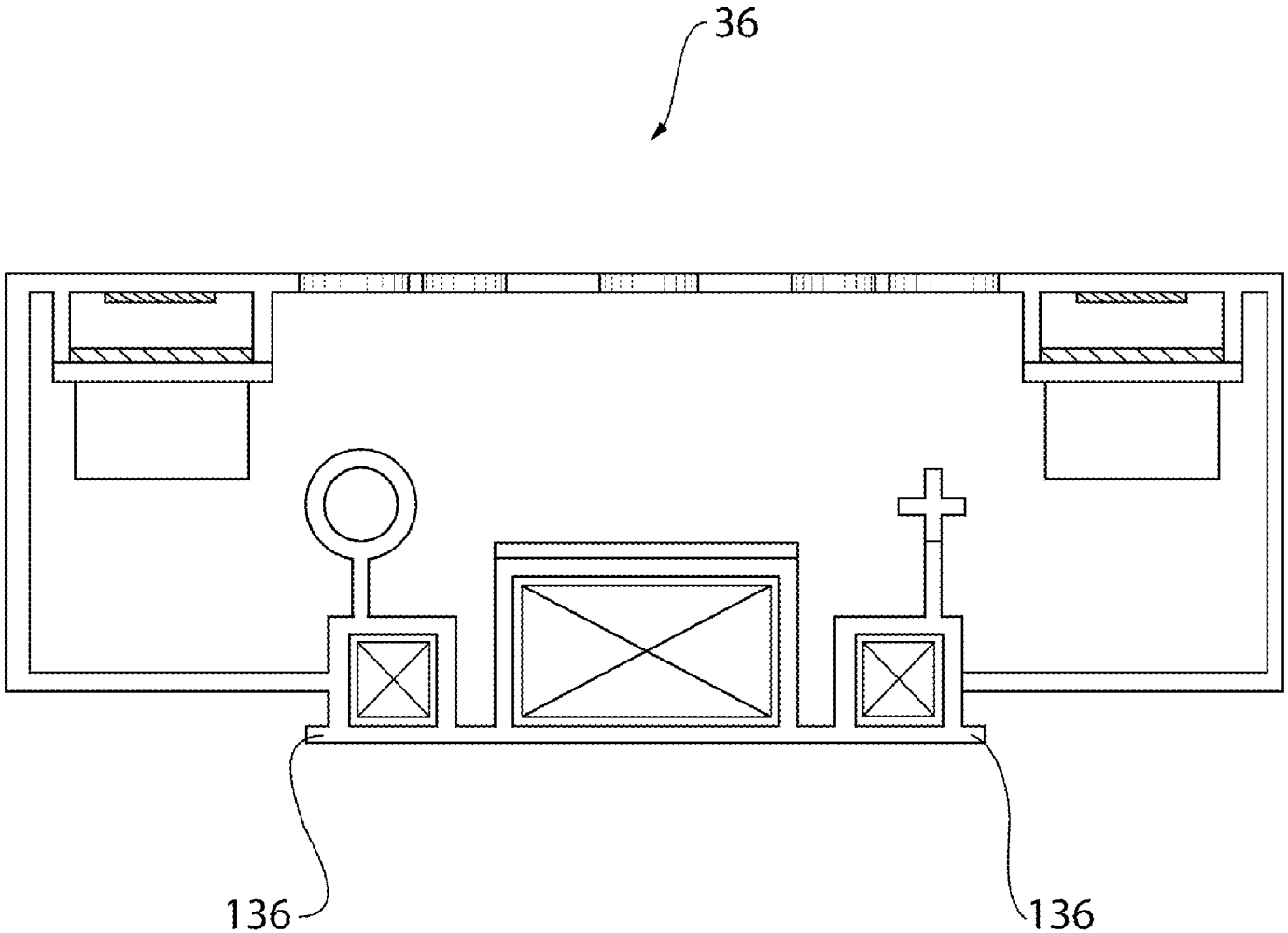
FIG. 8*b* is a plan view of another second support member.
Figure 9:
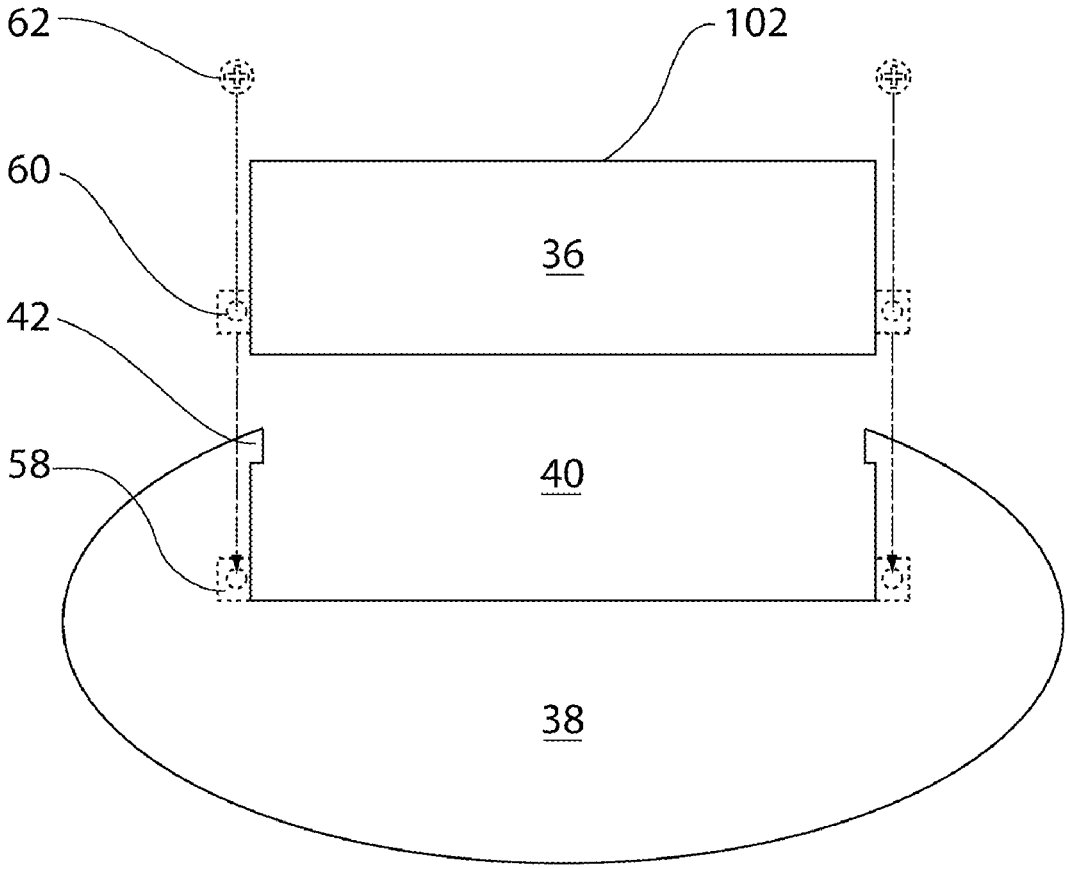
FIGS. 9 through 14 are schematic views of variations of components for use in the fixture of FIG. 1.
Figure 10:
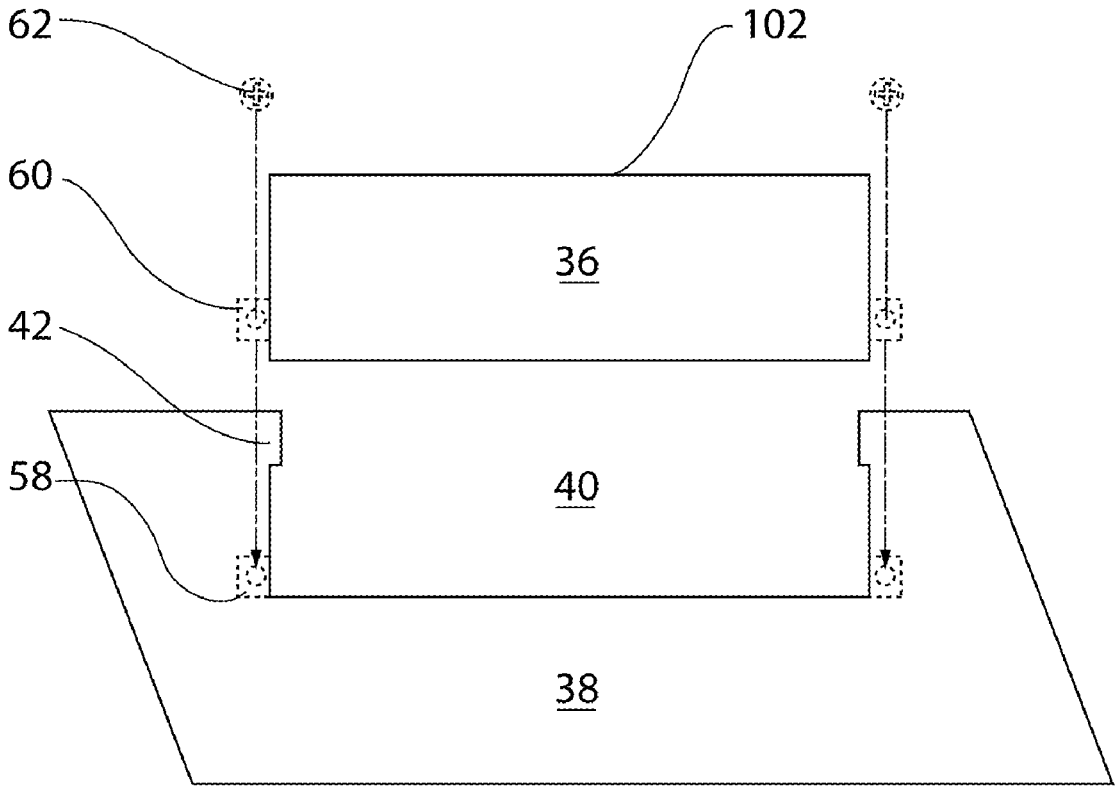
Figure 11:
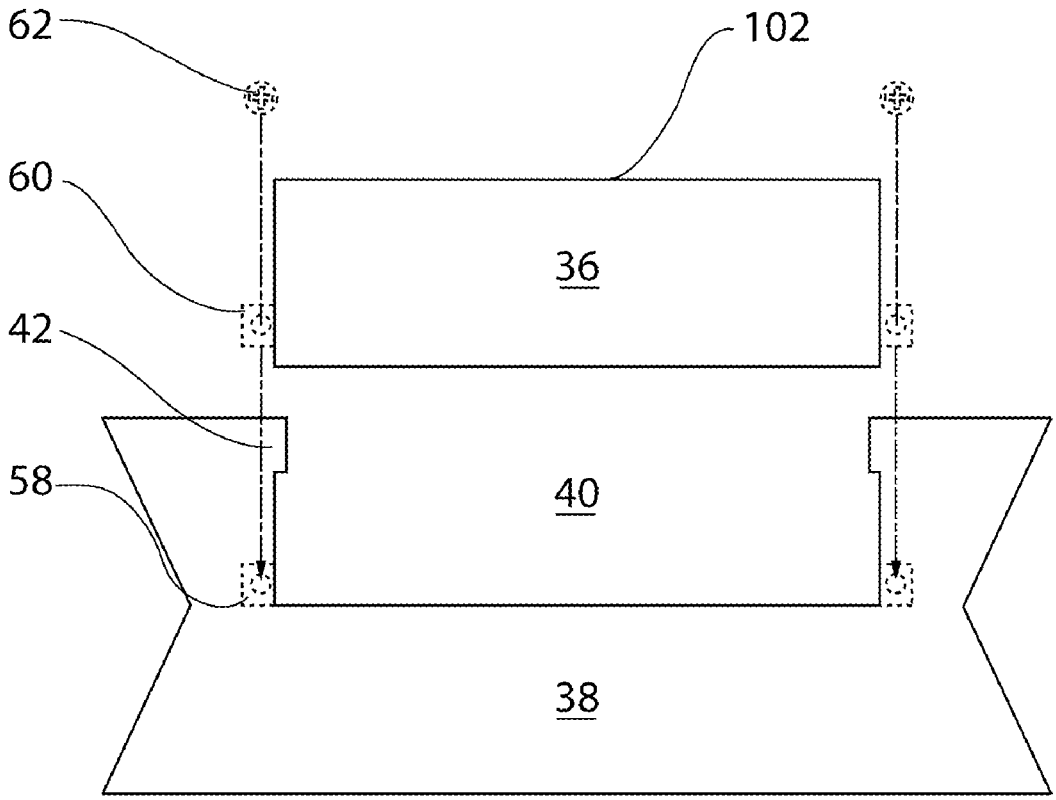
Figure 12:
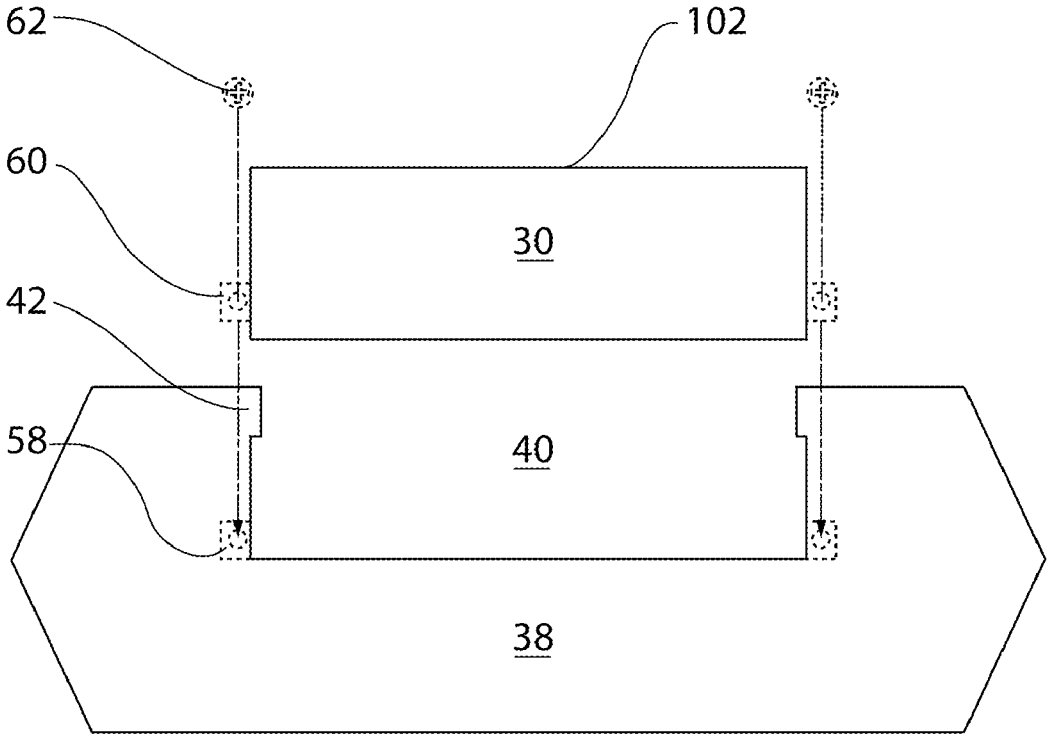
Figure 13:
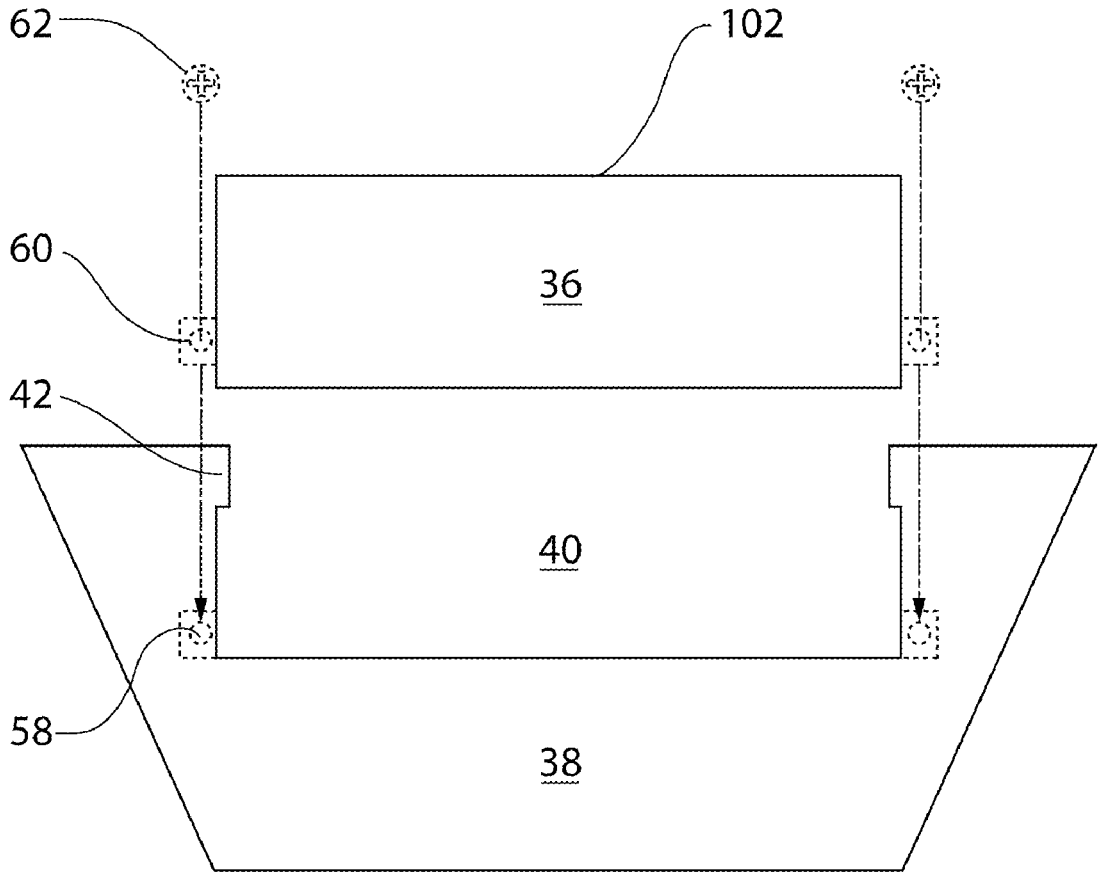
Figure 14:
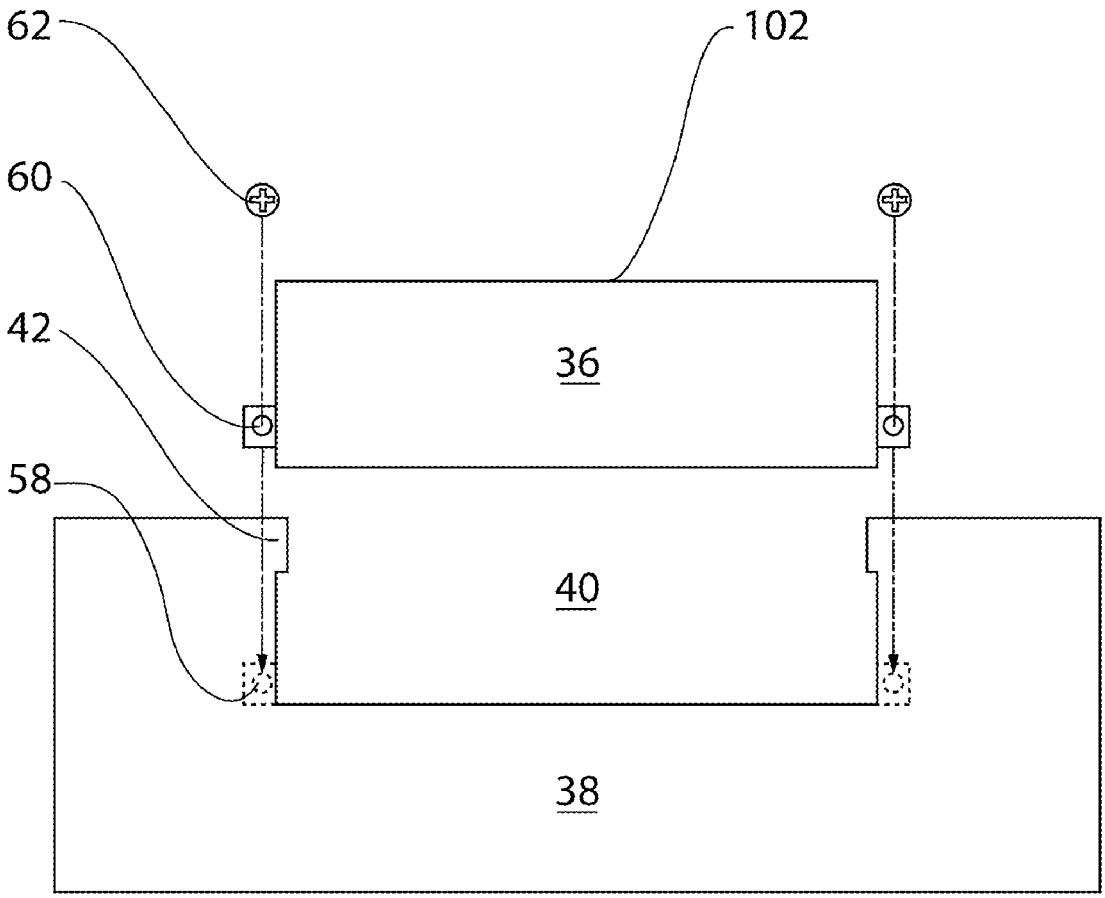

Another variation is shown in FIGS. 8*a* and 8*b* wherein the central track formation 132 is relatively wider, as provided by opposing tabs 134 to engage matching tabs 136 on the second support member 36.

The components of the support assembly 32 may be assembled in an assembly facility and then shipped to an installation site, or alternatively provided as discussed herein above in kit form for construction of a linear light fixture 10. During the construction of the linear light fixture 10, the components of the support assembly 32 are assembled together. The inner face 52 of the mounting flanges 50 slidably abuts the sides of the second support member 36. The first planar support member 34 is secured to the second support member 36. Thus, in this case, the second support member 36, generic in form and function, can fit one of many chosen linear housing designs.

The first planar support member 34 is thus arranged to have the planar body portion 38 positioned in the common boundary 30 between the linear housing 12 and the end portion 28 (FIG. 1) with its outer profile matching (and/or being complementary with) all or part of the outer cross sectional profile of the housing 12.

Alternatively, the first planar support member 34 may be arranged so that its outer profile matches or is complementary with all or part of the inner cross sectional profile of the linear housing 12. This means that the planar support member may be positioned within the linear support housing, if desired. The first planar support member 34 is releasably attached to the linear housing 12 and to the second support member 36, which in turn is attached to the housing 12.

If and when required, a further light source is optionally used by implementing the appropriate riser member, for example riser member 98 or riser member 100. Accordingly, the addition of an extra light source may be further enhanced with the addition of a secondary reflector panel 124 which is securely attached to the riser member wings 112 and/or to be supported by tongue 122 or horizontal extension 126 as the case may be. The complete support assembly 32 may, if desired, be put together prior to the attachment in to the linear housing 12.

Figure 15:
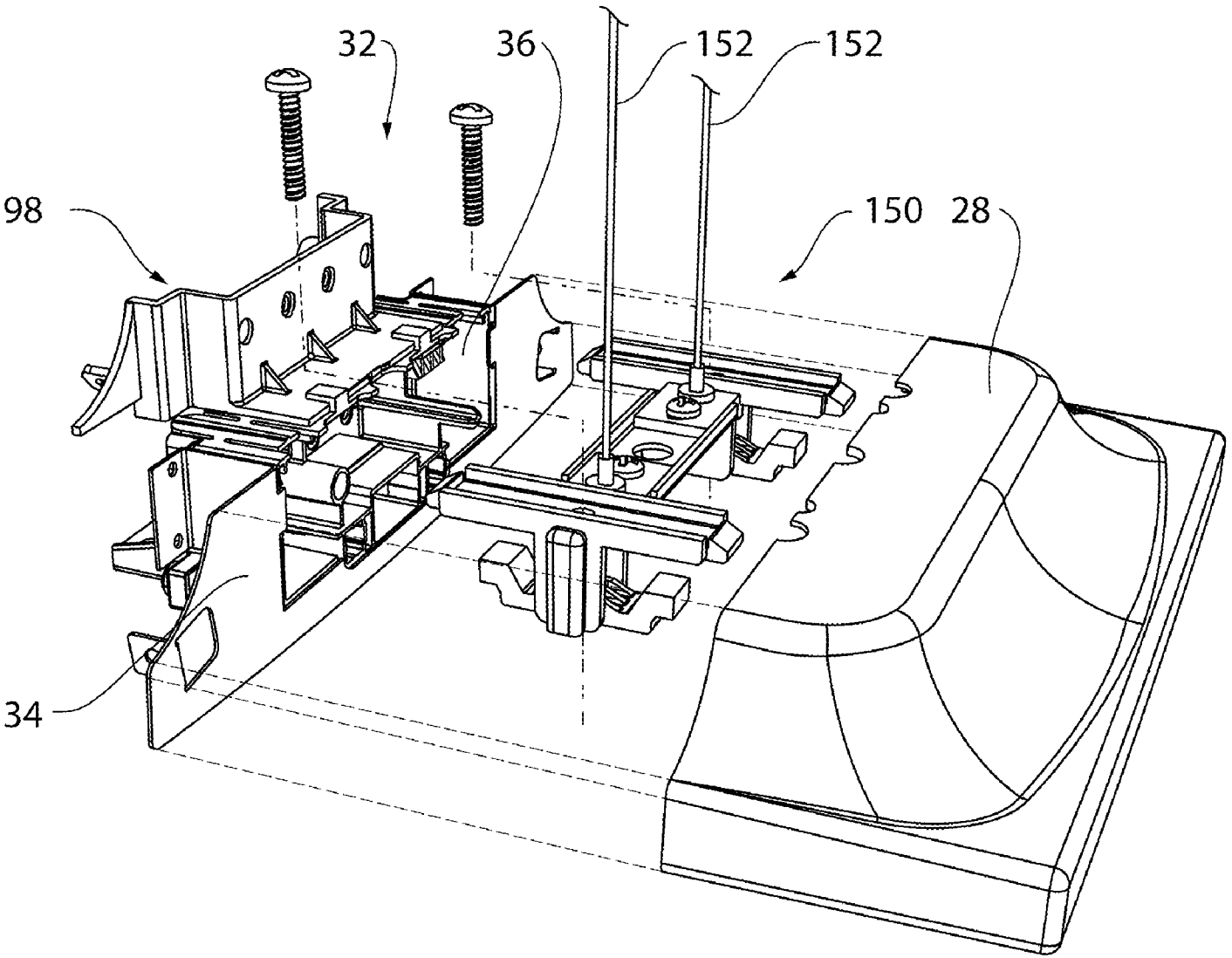
FIG. 15 is another fragmentary perspective view of the fixture of FIG. 1 aligned with a hanger member and end cap portion of the linear housing of FIG. 1.
Figure 15A:
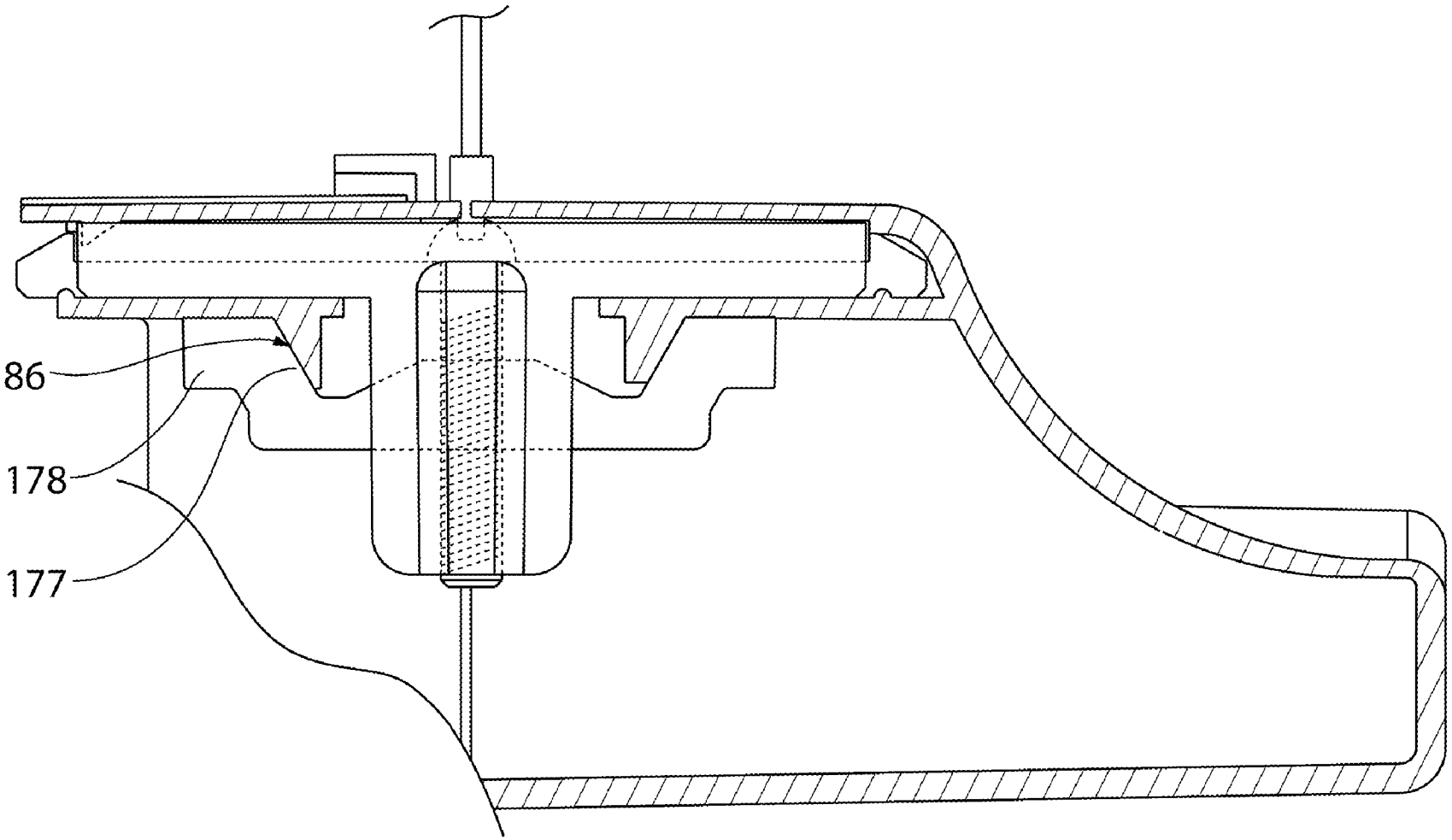
FIG. 15*a* is a fragmentary sectional view of the fixture of FIG. 1 in an operative position according to FIG. 15.
Figure 17:
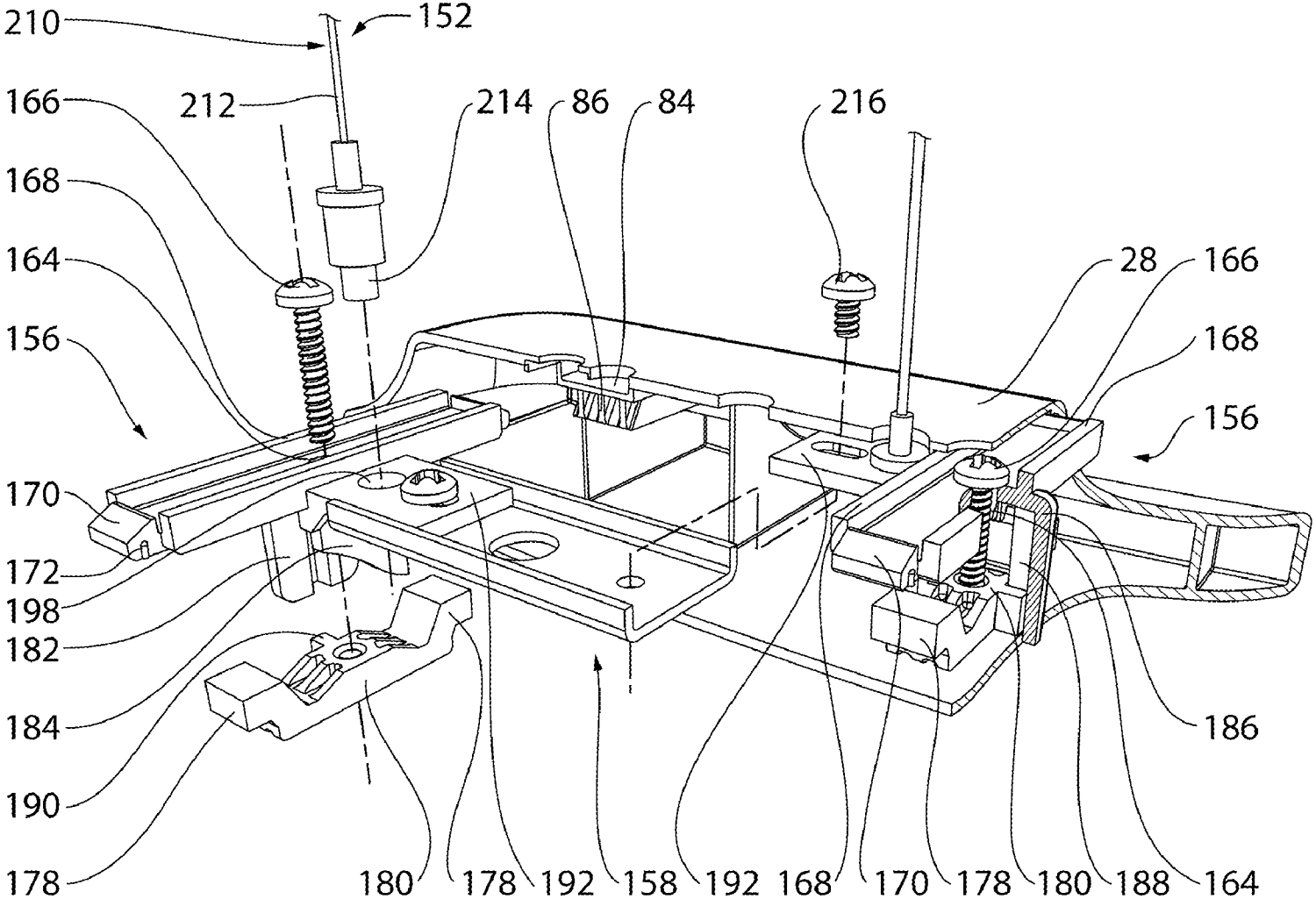
FIG. 17 is another fragmentary perspective view of the hanger member of fixture in an operative position.

Referring to FIGS. 15 and 17, there is shown a hanger member 150 for use in suspending the light fixture 10 from the overhead structure. The hanger member 150 is attached to a support assembly 32 and to an end portion 28 of linear housing 12 or to a support assembly 32 of an adjacent light fixture. The support assembly 32 is positioned along the linear housing 12. Complementary parts of the hanger member 150 align with corresponding support formations of the support assembly 32 to suspend the light fixture 10 from the overhead structure. A releasable suspension means 152 in the form of flexible or non-flexible restraining means, for example a pair of cables, extends vertically from the hanger member 150 to the overhead structure. For ease of reference, the attachment of the hanger member 150 to the second support member 36 of the support assembly 32 will be described as follows.

Figure 16:
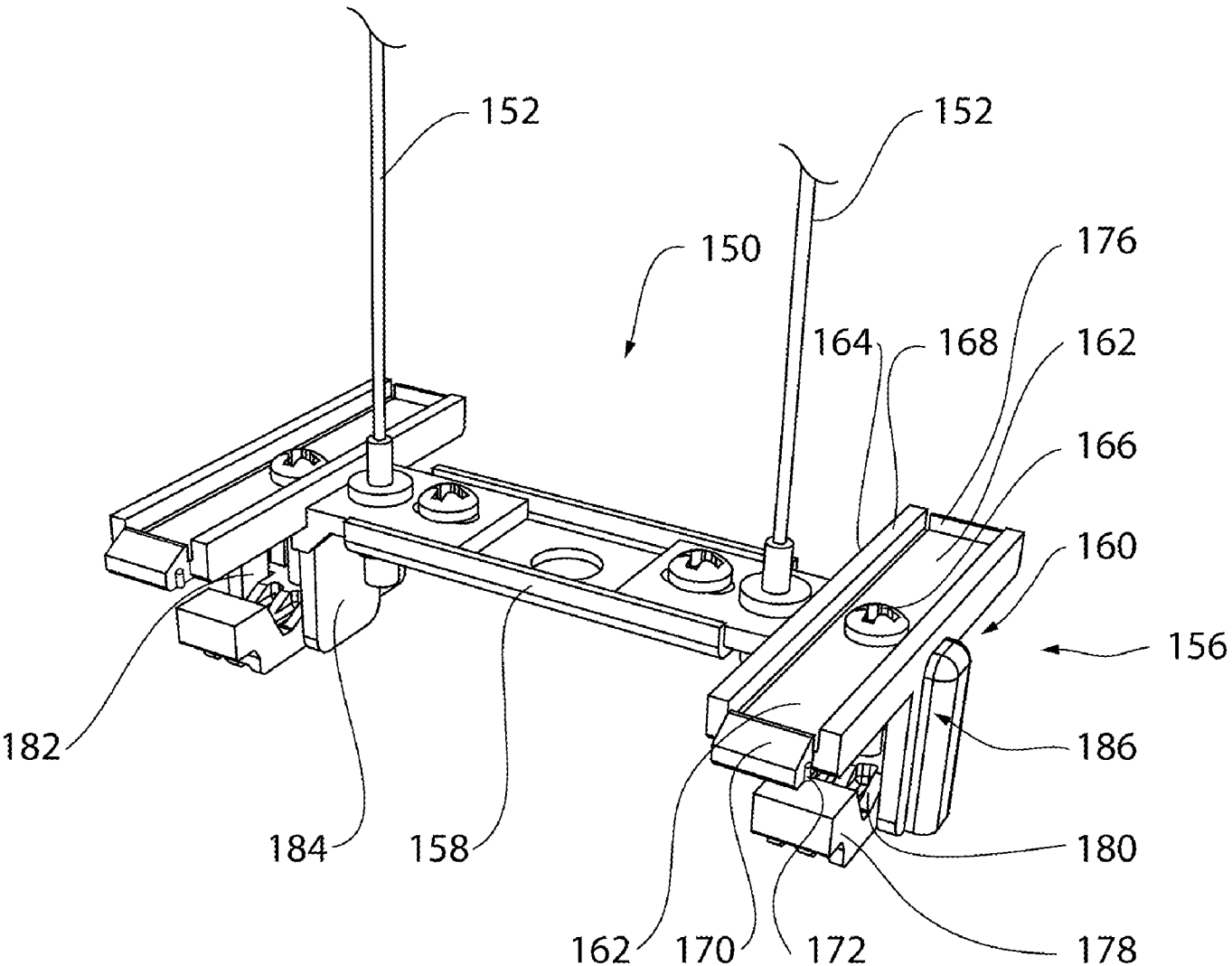
FIG. 16 is a perspective view of a hanger member portion of the fixture of FIG. 1.

Referring to FIG. 16, the hanger member 150 is symmetrical which allows the hanger member 150 to support two light fixtures 10 end to end. The hanger member 150 has two alignment members 156 that are the same in relation to their structure and function. Due to the symmetrical nature of the hanger member 150, the description of the hanger member 150 components will be described in the singular form. Each alignment member 156 is separated by a bridge member 158 that spans between each alignment member 156.

The alignment member 156 includes a one piece molded component having a T-shaped body portion 160 on the top of which there is a pair of opposed tongue portions 162 separated by a central interconnecting member 164 in which a vertically oriented adjustment screw 166 passes. On each side of the opposed tongue portions 162, there is a first upstanding peripheral region 168 that follows the longitudinal length on both sides of the alignment member 156. On each end of the opposed tongue portion 162, there is a tab 170, in the shape of wedged block with a notch 172 formed on an underside thereof.

Referring to FIGS. 3, 5 and 16, as previously mentioned, the second support member 36 has a pair of first and second support formations 84 and 86 respectively on either side of the second support member 36. The first support formations 84 have an elongate recess opened at both ends. At one end of the first support formation 84, there is an upper raised ridge 88 that is integrally formed in a resilient tongue 174 shown in FIG. 3 of the second support member 36. The resilient tongue 174 extends upwards when biased by the forward movement of the alignment member 156. The upper raised ridge 88 slidably abuts the wedge shaped tab 170 and engages a rear face 176 of the tab 170 thereby preventing any reverse movement of the alignment member 156. As an alternative or in combination, during the movement of the alignment member 156 into the recess of the first support formation 84, the lower raised ridge 90 engages the notch 172. The flexibility of the resilient tongue 174 relative to tab 170 allows the movement of the alignment member 156. To disengage the alignment member 156 from the secure engagement, the resilient tongue 174 is raised which disengages the resilient tongue 174 from the rear of the tab 170 of the alignment member 156.

Referring to FIGS. 5, 15*a* 16, and 17, the second support formation 86 is positioned immediately below the first support formations 84 and is provided in the form of a brace surface 177 which receives a wing 178 that is integrally formed in a clamping member 180. Each wing 178 is positioned in line with the central interconnecting member 164. The clamping member 180 is releasably attached to the alignment member 156 by the vertically oriented adjustment screw 166 that passes down through the central interconnecting member 164 and into the center of the clamping member 180. When there is enough distance in between the clamping member 180 and the opposed tongue portions 162, the clamping member 180 is loosely engaged with the second support formation 86 in a first operative position. In order to reduce the distance and essentially firmly engage the clamping member 180 into the second support formation 86, the vertically oriented adjustment screw 166 is manually adjusted vertically to raise the wings 178 relative to the central interconnecting member, such that the wings 178 clamp into and against the brace surface 177 of the support assembly 32 in a second operative position.

Referring to FIGS. 16 and 17, the raising of the clamping member 180 is guided on either side by a pair of parallel support flanges 182 having an inner side wall support 184 that slidably abuts the one side of the clamping member 180 and an outer support flange 186 that slidably abuts the other side of the clamping member 180. The outer support flange 186 has a rib portion 188 extending down from the alignment member 156. The clamping member 180 has a side lip 190 extending from a side of the clamping member 180, so as to engage a recess in the rib portion 188. In the first operative position the side lip 190 is in the lower region of the rib portion 188. As the vertically oriented adjustment screw 166 is adjusted, the side lip 190 rises along the rib portion 188 with the clamping member 180. The inner side wall supports 184 are positioned perpendicular to a lateral span member 192 that extends outwards from the middle of the first upstanding peripheral region 168 and toward the bridge member 158.

Figure 18:
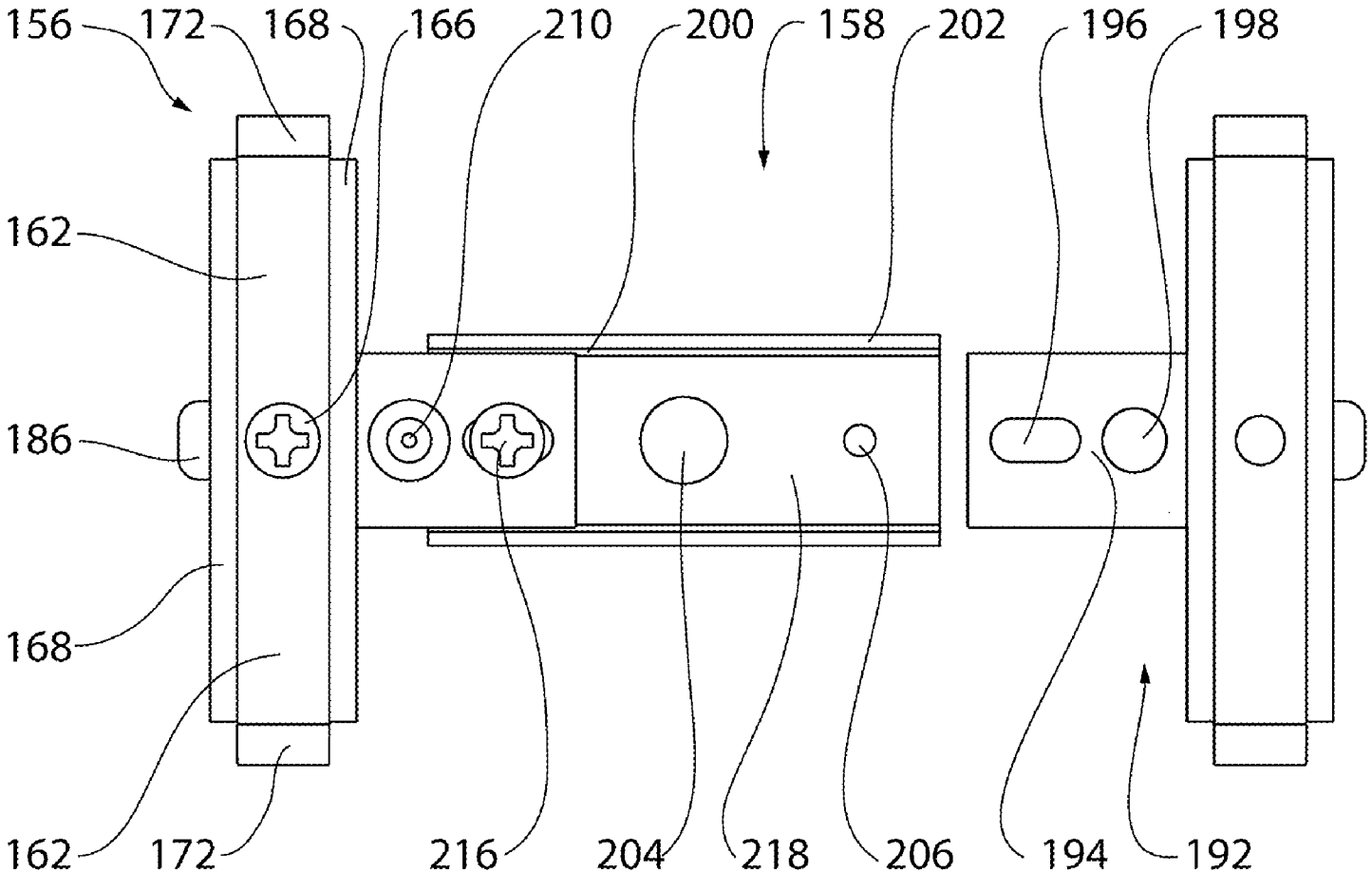
FIG. 18 is a plan part-assembly view of a bridge member used in the fixture of FIG. 1.

Referring to FIG. 18, on either side of a central point 194 of the lateral span member 192, there is a first passage 196 and a second passage 198. The first passage 196 has a length greater than its width, whereas the second passage 198, in contrast, is round in its dimension, though other configurations may be used as desired. The lateral span member 192 slidably abuts an inner surface region 200 and a second upstanding peripheral region 202 of the bridge member 158. The bridge member 158 has a central bridge passage 204 positioned between a pair of relatively smaller first and second adjacent bridge passages as shown at 206. The second passage 198 is operable to accept a releasable suspension means such as that shown at 152, for example, which in this case is provided by a cable assembly 210 (FIG. 17). The cable assembly 210 has a cable 212 attached to an end portion 214. In this case, the end portion 214 is threaded to engage the second passage 198, though other arrangements may be possible to secure the end portion 214 in the second passage 198 for instance. If desired, the end portion 214 of the cable assembly 210 may alternatively be held in place with, for example, a locking nut, washer or the like to clamp (not shown) the end portion 214 and, if desired, bias against the underside of the lateral span member 192, to secure the cable assembly 210 to the hanger member 150.

The first passage 196 of the lateral span member 192 receives a suitable fastener 216, for example, a threaded screw, to adjustably fasten the bridge member 158 to the lateral span member 192. In doing so, the lateral span members 192 can each slide in and along an inner surface region 218 of the bridge member 158, to adjust the spacing of the alignment members 156, thereby accommodating for a plurality of linear light fixtures with varying dimensions of first and second support formations (not shown).

The hanger member 150 is prepared for attachment to the support assembly 32 of the linear fixture 10 by adjusting the alignment members 156 so that the tongue portions 162 are oriented engage the recess of the first support formations 84 and by adjusting the wings 178 to pass into the second support formations 86. As each tongue portion 162 penetrates the first corresponding support formation 84, the tab 170 engages the lower raised ridge 90 and the upper raised ridge 88 to lock in position as above described. The step may be used to join a hanger member 150 to two adjacent support assemblies of two different linear fixtures or an end cap 28, for instance.

Thus, the lateral span members 192 themselves, by virtue of the passage in each of them, allows hanging devices to be attached directly to the lateral span members 192 without needing the bridge member 158. Alternatively, the bridge member 158 may be used to preset the spacing between the alignment members 156 so that they are installed in a single assembly step. Moreover, the bridge member 158 may be used to hang the hanger member 150 by way of a central holding device such relatively rigid support column or flexible support such as a cable, both provided with an engagement member to engage the central bridge passage 204. Furthermore, the engagement member may be clipped or be otherwise fastened to the bridge member without the need for the passage 204.

The hangar assembly and cables used to suspend it from a ceiling structure may be provided separately in a kit, together with the electrical and operational cables. The kit may then be used to fasten the hanger assembly to the associated ceiling structure during construction by a suitably constructed electrician. The power cable may be provided in three, four, five and six wire cable format to provide both the electrical cable and operational cable portions in a common wire assembly. Thus, the ceiling structure may be prepared first for the later installation of the linear fixtures. Thus, later on, the linear fixtures may be delivered on site with each linear fixture joined to a corresponding pair of hangar assemblies and with the power cables installed in the corresponding sockets, without the necessity of a qualified electrician. Advantageously, one or more devices herein provide, a linear light fixture with a support assembly that may be made to accommodate different linear housings with changes to its first planar support member. The first planar support member is manufactured so that its outer profile corresponds in shape or is otherwise complementary with a cross-sectional profile of the linear housing, be it an outer or inner cross sectional profile, for example. It is particularly advantageous and inexpensive to simply vary the dimensions of the first planar member to fit and/or be complementary with the shape of the linear housing, as opposed to matching the shape of the second support member therewith. This means that the relatively complicated structures of the second support member, with its features to secure both the electrical connector plug and the hanger member may remain unchanged. The universality of the second support member in relation to the universal central receiving region of the first planar support member, allows for the manufacture of a wide variety of first planar support members. In addition, in order to ensure the releasable coupling of the first planar support member to the second support member, each component has an integral coupling structure to enable the mating of the components.

The attachment of the first support member to the second support member is not limited to the use of tabs and flanges, as there are other means and ways to securely connect the two aforementioned members, for example, the use of bonding agents both chemical and non-chemical or releasable or non-releasable welding methods to accomplish the similar functions of flanges and tabs. A further example of non-chemical bonding is found in the use of Velcro®, wherein, for example, the linear housing has attached thereto the grappling hooks of the Velcro® for engagement with the receiving cloth attached to the first planar member.

The variety of suspension means used to suspend the light fixture from the over head structure may range from the currently used method of cables to the likes of wires, rods, chains, ropes other polymeric or metallic cords, and a solid column secured to the over head structure. The use of a wall bracket cantilevered to a remote anchor location makes use of the adaptable nature of the present invention. For example, the option to emit light from both the top and bottom portion of the linear light fixture is further enhanced by using one or more embodiments of the present invention. The very nature of the adaptable hanger members can allow for the angle of the linear light fixture to be slightly adjusted, to adjust the direction of the emitted light. For aesthetic reasons the entire outer periphery of the first support member need not necessarily engage the entire periphery of the housing, the first support member may equally function in some cases where its periphery engages on or abuts only a portion of the profile of the linear housing. An assortment of linear housing profiles is used with complementary first and second support members to accommodate a variety of fixtures for both functional and aesthetic purposes. Further embodiments of the present invention also provide for the alignment of a plurality of linear light fixtures with varying first and second support formations.

One or more devices herein may accommodate single, double or triple (or a greater number for that matter) light fixtures, by way of a controller, such as a low voltage lighting control provided by one or more one or more circuits which may be conveniently located in the housing if desired. In addition, one or more embodiments of the present invention may be provided with one or more reflector units attachable to the opposed anchoring flanges of the riser member wings.

One or more devices herein provide a method for manufacturing one or more than one linear housing, wherein the first housing profile is selected from a predetermined range of styles, provided with the appropriate flanges or other means of removably attaching the first and second support members together. Accordingly, the first housing profile is selected to complement a particular visual theme, which can be any profile in relation, for example, to a predetermined range of styles.

In one example, the first planar support member may be simply constructed by stamping out a metal plate to provide an outer profile to match the inner profile of a first model of the linear housing. The first planar support member may thus be further provided with anchoring flanges for selectively mounting the first planar support member to the housing. In this case, a generic second support member and may be complementary with the first planar support member, while the latter may accommodate a variety of other linear housing designs. Moreover, the position of the first planar support member in relation to the common boundary of the linear housing, can add to the design feature by incorporating in to the first planar support member an indicia representative of a predetermined design theme. For example, the first planar support member may have an outer profile which, while being complementary with the cross sectional profile of the housing, actually extends beyond to provide a visual break between housings, with esthetic treatment being applied to the exposed portion of the support member as desired.

While the devices herein have been described as linear light fixtures, it will be understood that the features of these devices may also be applied to other light fixtures that may not be considered linear. For example, the light fixture may have an arcuate or other shape or orientation and nonetheless benefit, for instance, in the two piece support assembly as described herein.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The entire subject matter of all U.S. and foreign patent documents discussed above are hereby incorporated by reference into the Detailed Description of the Preferred Embodiment.

The invention claimed is:

1. A housing support assembly for supporting a light fixture, said light fixture having an elongate linear housing for accommodating one or more than one lamp, the support assembly comprising a first planar support member and a second support member, said first support member having a central receiving region to receive the second support member and to be releasably coupled therewith, said first planar support member conforming to a predetermined cross-sectional dimension of the linear housing for releasable coupling therewith, said support assembly being adapted to mount one or more than one lamp socket thereon wherein the linear housing has a cross sectional profile, the first planar support member further having a first planar body portion having a profile which is complementary with the cross-sectional profile of the linear housing.

2. A support assembly of claim 1, wherein the first planar support member is made from a metal and/or a plastic or a combination thereof.

3. A support assembly of claim 1, wherein the first planar body portion further includes one or more than one mounting flange for releasably mounting said lamp socket thereon.

4. A support assembly of claim 3, further comprising a pair of mounting flanges, each arranged adjacent the second support member.

5. A support assembly of claim 3, wherein the first planar body portion further includes a pair of opposed positioning flanges, each positioning flange being located on a corresponding side of the central receiving region.

6. A support assembly of claim 5, further comprising a pair of mounting flanges, each being adjacent a corresponding positioning flange.

7. A support assembly of claim 6, wherein each positioning flange extends between the first planar body portion and the corresponding mounting flange.

8. A support assembly of claim 7, wherein the second support member is dimensioned to engage the positioning flanges.

9. A support assembly of claim 8, wherein each mounting flange extends parallel to the first planar body portion.

10. A support assembly of claim 9, wherein the mounting flanges, the positioning flanges and the first planar body portion are formed from a one piece member.

11. A support assembly of claim 1, wherein the first planar support member further includes one or more than one anchoring flange projecting from the first planar body portion, said anchoring flange being arranged for releasable attachment to the second support member.

12. A support assembly of claim 11, wherein the second support member further includes one or more than one anchoring tab extending therefrom.

13. A support assembly of claim 12, further comprising a pair of first anchoring flanges on the first planar body portion and a pair of first anchoring tabs on the second support member, each first anchoring flange to align with a corresponding first anchoring tab to receive a fastener therewith.

14. A support assembly of claim 13, wherein the first anchoring tab is operable for releasable attachment to a corresponding first anchoring flange of the first planar support member.

15. A support assembly of claim 13, further comprising one or more second anchoring flanges extending from opposite regions of the first planar body portion, each second anchoring flange to be oriented to align with a corresponding first anchor location in the linear housing to receive a fastener therewith.

16. A support assembly of claim 15, further comprising one or more second anchor tabs on opposite sides of the second body portion, each to align with a corresponding second anchor location on the linear housing to receive a fastener therewith.

17. A support assembly of claim 16, further comprising a riser member, the second support member further including one or more than one releasable receiving flange to accommodate the riser member.

18. A support assembly of claim 17, wherein said riser member includes a central region to accommodate one or more than one lamp socket thereon.

19. A support assembly of claim 18, wherein the riser member further includes a pair of anchoring flanges each on an opposite side of the central region.

20. A support assembly of claim 19, wherein the second support member further includes an upper surface and a ridge extending above the upper surface, the riser member further including a locating groove for engaging the riser member.

21. A support assembly of claim 17, further comprising a tongue outwardly extending from the second member to support one or more than one lamp thereon.

22. A support assembly of claim 2, wherein the tongue is releasably attachable to the second support member.

23. A support assembly of claim 2, wherein the second support member, the riser member and/or the tongue are molded from plastic and/or metal or a combination thereof.

24. A housing support assembly for supporting a light fixture, said light fixture having an elongate linear housing for accommodating one or more than one lamp, the support assembly comprising a first planar support member and a second support member, said first support member having a central receiving region to receive the second support member and to be coupled therewith, said first planar support member conforming to a predetermined cross-sectional dimension of the linear housing for releasable coupling therewith, said support assembly being adapted to mount one or more than one lamp socket on the first and/or second support member, wherein said elongate linear housing has a cross sectional profile, said first planar support member further having a first planar body portion with a profile complimentary to said cross sectional profile of said elongate linear housing.

25. A housing support assembly for supporting a light fixture, said light fixture having an elongate linear housing for accommodating one or more than one lamp, the support assembly comprising a first support blank and a second support member, said first support blank being formed with a central receiving region to receive the second support member, said first support blank having a peripheral region which is formed to conform to a predetermined cross-sectional dimension of the linear housing for releasable coupling therewith, said support assembly being adapted to mount one or more than one lamp socket thereon wherein said elongate linear housing has a cross sectional profile said first planar support member a first planar body portion with a profile complimentary to said cross sectional profile of said elongate linear housing.

26. An assembly as defined in claim 25, wherein the first support blank is elongate.

27. An assembly as defined in claim 26, wherein the first support blank is planar.

28. An assembly as defined in claim 25, wherein the first support blank includes a stamped plate member.

29. An assembly as defined in claim 25, wherein the first support blank is a plate member.

30. An assembly as defined in claim 25, wherein the plate member is planar.

31. An assembly as defined in claim 25, wherein the first support blank and the second support member are releasably coupled together.

32. A method of preparing a plurality of different light fixture assemblies, comprising the steps of:

providing a pair of first support assemblies and a first housing, which when assembled form part of a first light fixture;

providing a pair of second support assemblies and a second housing, which when assembled form part of a second light fixture;

providing the first housing with a first cross sectional profile and the second housing with a second cross sectional profile which is different from the first cross sectional profile;

providing each first support assembly with a first plate member and a first block member supported thereby;

shaping the outer periphery of the first plate member to be complementary with at least a portion of the cross sectional profile of the first elongate linear housing;

providing each second support assembly with a second plate member and a second block member supported thereby, wherein the second block member and the first block member are substantially the same;

shaping the outer periphery of the second plate member to be complementary with at least a portion of the cross sectional profile of the second elongate linear housing;

locating an electrical and/or network coupling in one or both of the first block members of the first support assemblies for delivering power to an interior region of the first and elongate linear housing;

locating an electrical and/or network coupling in one or both of the second block members of the second support assemblies for delivering power to an interior region of the second elongate linear housings;

locating one or more lamps in the first and second elongate linear housings; and coupling each of the lamps with a corresponding electrical coupling.

* * * * *